US007739796B2

(12) United States Patent
Froese

(10) Patent No.: US 7,739,796 B2
(45) Date of Patent: Jun. 22, 2010

(54) METHOD FOR MONITORING A HOLLOW POST ABOUT A PIPE

(76) Inventor: Joseph S. Froese, Box 6, Brunkild, Manitoba (CA) R0G 0E0

( * ) Notice: Subject to any disclaimer, the term of this patent is extended or adjusted under 35 U.S.C. 154(b) by 0 days.

(21) Appl. No.: 12/045,323

(22) Filed: Mar. 10, 2008

(65) Prior Publication Data

US 2008/0216443 A1 Sep. 11, 2008

Related U.S. Application Data

(63) Continuation-in-part of application No. 11/370,173, filed on Mar. 8, 2006, now Pat. No. 7,398,961.

(30) Foreign Application Priority Data

Mar. 8, 2007 (CA) ..... 2581717

(51) Int. Cl.
*B21D 47/00* (2006.01)
*E02D 27/42* (2006.01)

(52) U.S. Cl. ..... 29/897; 52/741.15

(58) Field of Classification Search ..... 29/428, 29/7.1, 897, 897.33; 52/741.15, 301, 736.3, 52/169.13, 170, 223.13; 256/65.14, 19
See application file for complete search history.

(56) References Cited

U.S. PATENT DOCUMENTS 5,722,205 A * 3/1998 Gannaway ..... 52/155

* cited by examiner

*Primary Examiner*—John C Hong
(74) *Attorney, Agent, or Firm*—Ade & Company Inc.; Kyle R. Satterthwaite; Ryan W. Dupuis

(57) ABSTRACT

Systems use mounting devices arranged to support a hollow post on or position the hollow post around a pipe. One lower mounting device slides along the pipe prior to fastening thereto to allow change or adjustment of a height at which the hollow post is to be supported on a base of the device. Another mounting device can be used with or without a base-defining attachment to facilitate selective use of the device to either support the bottom end of the post on the optional base or instead just engage the post's interior surface at any point along the post for positioning thereof about the pipe. Another mounting device is directly fastenable to the pipe through a wall projecting from the device's body or alternatively cooperable with a second body mountable on the pipe for engagement with this second body in different positions relative to the pipe.

11 Claims, 17 Drawing Sheets

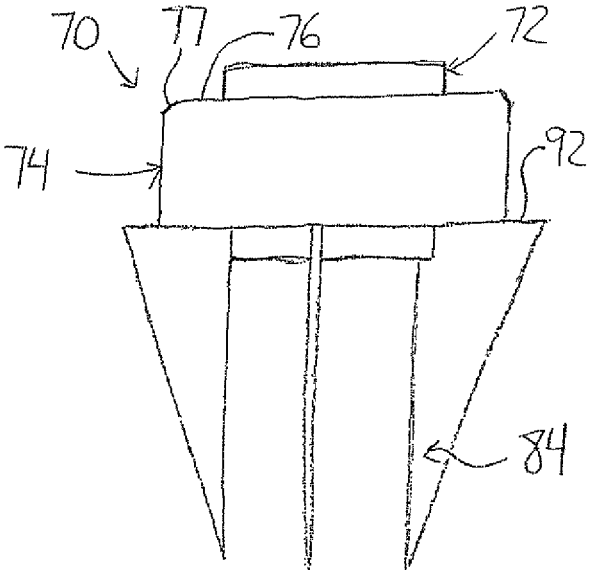
FIG. 13A
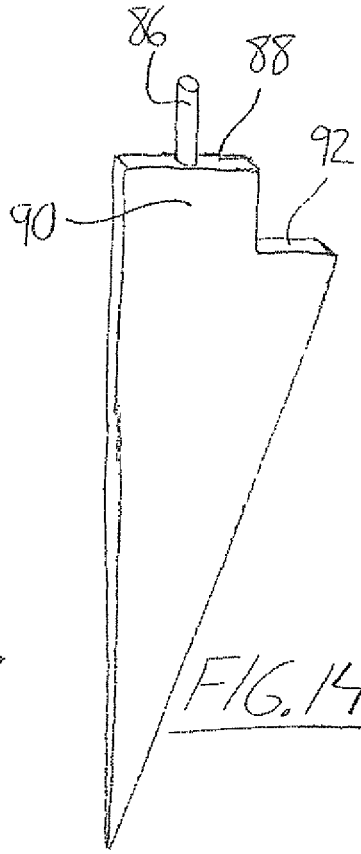
FIG. 14
FIG. 13C
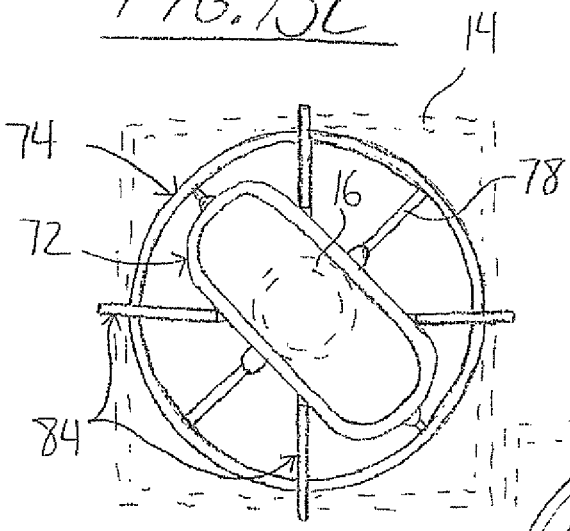
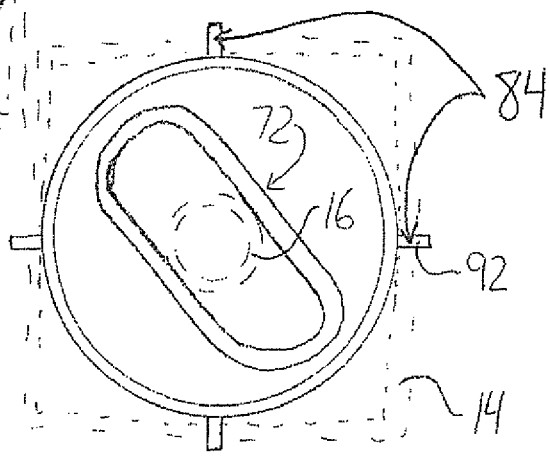
FIG. 13B

METHOD FOR MONITORING A HOLLOW POST ABOUT A PIPE

This application is a continuation-in-part of U.S. application Ser. No. 11/370,173, filed Mar. 8, 2006, and claims foreign priority benefits from Canadian Patent Application No. 2,581,717 filed Mar. 8, 2007.

This invention relates to a system for mounting a hollow post about a pipe and more particularly relates to a system having upper and lower mounting devices supported on the pipe at spaced heights therealong to engage the hollow post.

BACKGROUND OF THE INVENTION

Plastic or vinyl rail assemblies, for example for use in fencing and decking, are gaining popularity due to their durability and pleasant appearance. Unlike wood used in conventional fencing or decking rail assemblies, the plastic or vinyl components do not require post-sale painting and weatherproofing and will not rot over time. Rail assemblies feature horizontal rails supported on and extending between vertical posts spaced apart along a straight line. Plastic or vinyl posts are usually manufactured to be hollow, and as such are usually fitted over and supported about rigid pipes that provide the necessary strength to support the final structure. The rigid pipe may be supported by driving a lower end thereof a distance into the ground or by anchoring it to some kind of foundation or support surface that must be provided on/in/above the ground. Different devices have been developed for positioning the hollow post about the pipe for each of these situations.

U.S. Pat. No. 6,213,452 discloses a base plate adapted to engage both the hollow vinyl post and the interior support pipe to support them to extend upward from a horizontal support surface. Installation of a series of posts to create a substantially horizontal rail assembly may prove difficult in situations where the ground surface features irregularities that deviate from the horizontal, as the support surfaces for some base plates may have to be built up from or recessed into the ground to support neighbouring posts at a common elevation. Building up of a base plate may require additional materials to do so and recessing a base plate may require accurate earth removal to form a horizontal surface at a specific depth. Adjustment of relative tilt between longitudinal axes of the post and pipe is achieved through adjustment of screws extending radially outward from the pipe near an upper end thereof, such that each screw engages an inner surface of the hollow post at a desired distance from the pipe. Allowing misalignment of the axes of the post and pipe allows the post to extend vertically about the pipe even if the pipe is not perfectly vertical. Access to the screws likely requires either removal of the hollow post from about the pipe or formation of openings in the hollow post through which they can be accessed.

U.S. Pat. No. 6,523,808 discloses a fixture for positioning the hollow post concentrically about the pipe regardless of how the pipe is anchored at its lower end. The fixture features a round inner cylinder which is slid over the pipe and fastened thereto and a larger round outer cylinder that engages inner surfaces of the hollow post to retain it at a fixed distance from the pipe in all directions. Two fixtures are used to position the post near the top and bottom ends thereof. The post is lowered over the fixtures until a bottom end thereof engages a base surface for support thereon. For the reasons provided in the preceding paragraph, providing a series of equally elevated horizontal support surfaces over a distance may require substantial effort, materials and/or time.

Mounting devices similar to the fixture described above have been developed in which the round inner cylinder is replaced with an oblong collar having an inner width substantially equal to an outer diameter of the pipe so that the axes of the pipe and mounting device can be misaligned by movement of the pipe within the collar before fastening of the two. This allows relative positioning of the hollow post and pipe such that the post can be disposed in a vertical orientation even if the pipe about which it is disposed is not perfectly vertical. It should be appreciated that after fastening, further adjustment of the mounting device requires unfastening it from the pipe and moving it relative thereto for refastening. Such further adjustment therefore would require access to the mounting device, for example by either at least partial removal of the post from about the pipe or the formation of openings in the post to access the mounting device fastener therein.

SUMMARY OF THE INVENTION

According to a first aspect of the invention there is provided a system for mounting a hollow post about a pipe, the system comprising:

a lower mounting device for supporting the hollow post about the pipe, the lower mounting device comprising:

a body defining a pipe-receiving passage therethrough through which the pipe is passable;

at least one ledge defined outward from the pipe-receiving passage in the body to form a base having an inner and outer dimensions, the inner dimension of the base being less than an outer dimension of the hollow post and the outer dimension of the base being greater than an inner dimension of the hollow post so that a lower end of the hollow post can rest on the base; and a post-engaging mechanism adapted to engage the hollow post upon receipt thereof onto the base to retain the hollow post thereon;

and an upper mounting device for positioning the hollow post about the pipe at a distance upward along the pipe from the lower mounting device;

the lower mounting device being positionable along the pipe by relative movement of the pipe through the pipe-receiving passage to define a height at which the hollow post is supported on the base.

The movement of the lower mounting device along the pipe allows an installer to quickly and easily adjust the elevation of the base on which the hollow post is to be mounted, for example to ensure rails later connected between the posts will extend horizontally to give a neat, pleasant appearance regardless of fluctuations in the ground surface. In this example, once a lower mounting device has been fastened to a first pipe at a desired elevation, the lower mounting device of a neighbouring post can be aligned with that of the first using a laser level, string or other straight line and then fastened in place. Supporting the base on the pipe rather than the ground reduces the time, effort and materials needed to provide alignment of the support surfaces of neighbouring posts.

The lower mounting device may further comprise an earth-engaging mechanism connected to the body for stabilization thereof. Preferably the earth-engaging mechanism comprises at least one earth piercing element extending downward from the body. Preferably the at least one earth-piercing element comprises a plurality of piercing elements spaced about the pipe receiving passage in the body. The earth engaging mechanism may define the at least one ledge forming the base. The piercing elements allow an additional use of the lower mounting device as a stable position marker for installing the pipe. The piercing elements are driven into the ground to hold the lower mounting device in place to mark a desired post position, after which the pipe can be driven into the ground through the pipe-receiving passage. Depending on where along the pipe the lower mounting device is later fastened to define the base height of the post, the piercing elements may also engage the ground in this fastened position to further stabilize the base.

Preferably the post-engaging mechanism of the lower mounting device comprises at least one post-engaging element extending upward from the base for contact with inner surfaces of the hollow post upon receipt thereof onto the base.

Preferably the at least one post-engaging element comprises a closed wall extending about the pipe receiving passage in the body.

Preferably the closed wall is substantially annular.

There may be provided a second post-engaging mechanism for engagement with a larger post at a distance further from the pipe-receiving passage than the first post-engaging mechanism. The first pipe-engaging mechanism may extend upward from the base further than the second pipe engaging mechanism. Two post-engaging mechanisms on a single lower mounting device allows use of the device with posts of two different sizes to eliminate the need to produce separate devices for each size of post.

Preferably the lower mounting device further comprises a pipe collar extending upward from the body and defining a passage in communication with the pipe-receiving passage in the body. Preferably the pipe collar extends upward above the pipe engagement mechanism. Extending significantly upward from the base, the collar provides an attachment point for fastening to the pipe which is open for access in radial directions.

The pipe-receiving passage in the body may be elongated in cross section to have a cross sectional length greater than a width of the pipe.

According to a second aspect of the invention there is provided a system for mounting a hollow post about a pipe, the system comprising:

a lower mounting device for positioning the hollow post about the pipe; and an upper mounting device for positioning the hollow post about the pipe at a distance upward along the pipe from the lower mounting device, the upper mounting device comprising:

a first member adapted to engage an exterior of the pipe; and a second member being adapted to engage an interior of the hollow post;

the first and second members being movable relative to one another between an unengaged state and any of a plurality of engaged states; and the first and second members interlocking in each of the engaged states to secure the first member in a different respective position relative to the second member in a plane perpendicular to the pipe.

In one embodiment, engaged to separate ones of the pipe and hollow post, the two members of the upper mounting device are movable to their unengaged state through relative motion between the pipe and the hollow post supported thereabout. As a result, the upper mounting device can be adjusted to reposition the hollow post about the pipe upward from the lower mounting device without having to remove the post or otherwise gain access to the upper mounting device.

Preferably the first member of the upper mounting device is disposed below the second member thereof along the pipe in the unengaged state.

Preferably the second member of the upper mounting device is supported on the first member thereof in each of the engaged states.

Preferably the positions of the first member of the upper mounting device relative to the second member thereof in the engaged states are linearly disposed along the plane perpendicular to the pipe.

Preferably relative rotation between the first and second members of the upper mounting device is prevented by the interlocking in each of the engaged states.

Preferably the second member of the upper mounting device a passage therethrough being greater in size than an outer dimension of the first member and the first member is received at least partly within the passage of the second member in each of the engaged states.

Preferably the first member of the upper mounting device has teeth extending outward therefrom and the second member has teeth extending into the passage, the teeth of the inner member intermeshing with the teeth of the outer member with the first and second members in the engaged state.

Preferably the upper mounting device further comprises a third member engaged to the second member, the third member being adapted to engage an interior of a larger hollow post.

Preferably the third member of the upper mounting device is engaged to the second member to be movable therewith between the engaged state and any of the unengaged states.

According to a third aspect of the invention there is provided a method for mounting a hollow post about a pipe, the method comprising the steps of:

(a) providing a lower mounting device having a pipe-receiving opening extending therethrough and a base defined outward from the pipe-receiving opening;

(b) positioning the lower mounting device and the pipe such that the pipe extends upward away from a ground surface to which it is anchored through the pipe-receiving opening in the lower mounting device;

(c) sliding the lower mounting device axially along the pipe to adjust a height along the pipe at which the base is to be positioned to support the hollow post thereon;

(d) fastening the lower mounting device to the pipe with the base of the lower mounting device positioned at the adjusted height; and (e) lowering the hollow post over the pipe to the lower mounting device until the hollow post is supported on the base of the lower mounting device outward from the pipe.

Preferably there is provided the step of, prior to step (e), supporting an upper mounting device on the pipe at a position upward therealong from the lower mounting device to subsequently engage the hollow post when lowered over the pipe in step (e).

Preferably there is provided the step of, after step (d), using the adjusted height of the lower mounting device to determine an elevation at which a second lower mounting device on a second pipe should support a second hollow post. Preferably a straight line is used to position the second lower mounting device in alignment with the lower mounting device previously installed in step (d).

Preferably there is provided the step of, prior to step (b), marking positions along the ground surface at which the pipes are to be installed by engaging the lower mounting devices to the ground surface at said positions, wherein step (b) comprises driving the pipe into the ground surface through the pipe receiving opening.

There may be provided the step of, prior to step (c), digging out earth at a position where the pipe extends upward from the ground surface, wherein step (c) then comprises sliding the lower mounting device along the pipe to position the base below the ground surface. In this instance, preferably step (d) comprises fastening the lower mounting device to the pipe above the ground surface at a pipe collar extending upward from the base past the ground surface.

Step (d) may comprise engaging the hollow post with one of two post-engaging mechanisms carried on the base, the two post-engaging mechanisms arranged to engage differently sized posts. In this instance, preferably each post-engaging mechanism comprises at least one protrusion extending upward away from the base for contact with inner surfaces of a respective one of the differently sized posts upon lowering thereof toward the base and the two post-engaging mechanisms comprise inner and outer mechanisms, the inner mechanism being situated between the pipe-receiving opening and the outer mechanism and projecting further upward away from the base than the outer mechanism.

According to a fourth aspect of the invention there is provided a system for mounting a hollow post about a pipe, the mounting device comprising a mounting device comprising a body having a pipe-receiving passage extending therethrough through which the pipe is passable to fit the body around the pipe, the body having an outer surface situated outward from the pipe receiving passage to engage against the hollow post when the hollow post is lowered over the pipe to fit around the body fitted around the pipe; and an attachment optionally connectable to the body of the mounting device to extend outward from the outer surface thereof to define a base onto which the hollow post can be lowered to sit thereatop when lowering the hollow post over the pipe to fit around the body and engage against the outer surface thereof;

the optional connection of the attachment facilitating installation of the mounting device on the pipe either without the attachment, so as to engage the hollow post lowered over the pipe at any selected position along the hollow post, or with the attachment, so as to support the bottom end of the hollow post lowered over the pipe sitting atop the base.

Preferably the attachment comprises an earth-engaging mechanism also extending downward from the body when connected thereto for engaging into earth from which the pipe extends upward.

Preferably the earth-engaging mechanism comprises a plurality of earth-piercing elements spaced about the pipe receiving opening in the body and each defining a ledge extending outward from the body.

Preferably the passage has a cross-sectional length greater than a diameter of the pipe to allow shifting of the body relative to the pipe along the cross-sectional length of the passage.

According to a fifth aspect of the invention there is provided a system for positioning a hollow post about a pipe, the system comprising:

a first body adapted to engage an interior of the hollow post;

a passage extending through the first body along an axis and dimensioned to have the pipe passable therethrough, the passage having a cross-sectional length greater than a diameter of the pipe to allow shifting of the first body relative to the pipe along the cross-sectional length of the passage;

at least one wall positioned to a side of the passage, the wall protruding away from the body along the axis of the passage and extending along the cross sectional length of the passage; and an engagement mechanism associated with the first body and arranged to selectively engage the first body in any of a plurality of engaged states with a second body adapted to engage an exterior of the pipe to selectively interlock the first and second bodies in different relative positions in a plane perpendicular to the pipe.

With the at least one wall provided at the side of the passage, the mounting device can be used with or without the second body, as the wall(s) immediately beside the passage can be used to pass a fastener, such as a screw, therethrough to mount the first body to the pipe.

Preferably the engagement mechanism comprises projections extending from one body of the first and second bodies and receiving spaces defined between features formed on the other body such that the projections of the one body are cooperatively received in any set of the receiving spaces of the other body, each set of receiving spaces corresponding to a respective engaged state of the first and second members.

Preferably the engagement mechanism comprises a plurality of teeth carried on the first body and protruding into the passage from each of opposite sides thereof extending between the opposite ends of the cross sectional length of the passage, the teeth being dimensioned to fit the pipe between the teeth situated at the opposite sides of the passage.

Preferably the plurality of teeth are arranged to selectively engage in any of the plurality of engaged states with a second plurality of teeth carried on an outer surface of the second body to interlock the first and second bodies in different relative positions in a plane perpendicular to the pipe.

Preferably the at least one wall comprises a pair of walls on opposite sides of the passage, with this pair preferably disposed at one end of the passage.

Preferably the at least one wall comprises walls disposed at opposite ends of the passage.

BRIEF DESCRIPTION OF THE DRAWINGS

In the accompanying drawings, which illustrate exemplary embodiments of the present invention:

FIGS. 13A, 13B and 13C are the same views as FIGS. 12A, 12B, and 12C respectively, but with ground piercing spikes installed on the third embodiment mounting device for specific use thereof as a lower mounting device.

FIG. 14 is an isometric view of one of the ground piercing spikes of FIG. 13.

DETAILED DESCRIPTION

Figure 1:
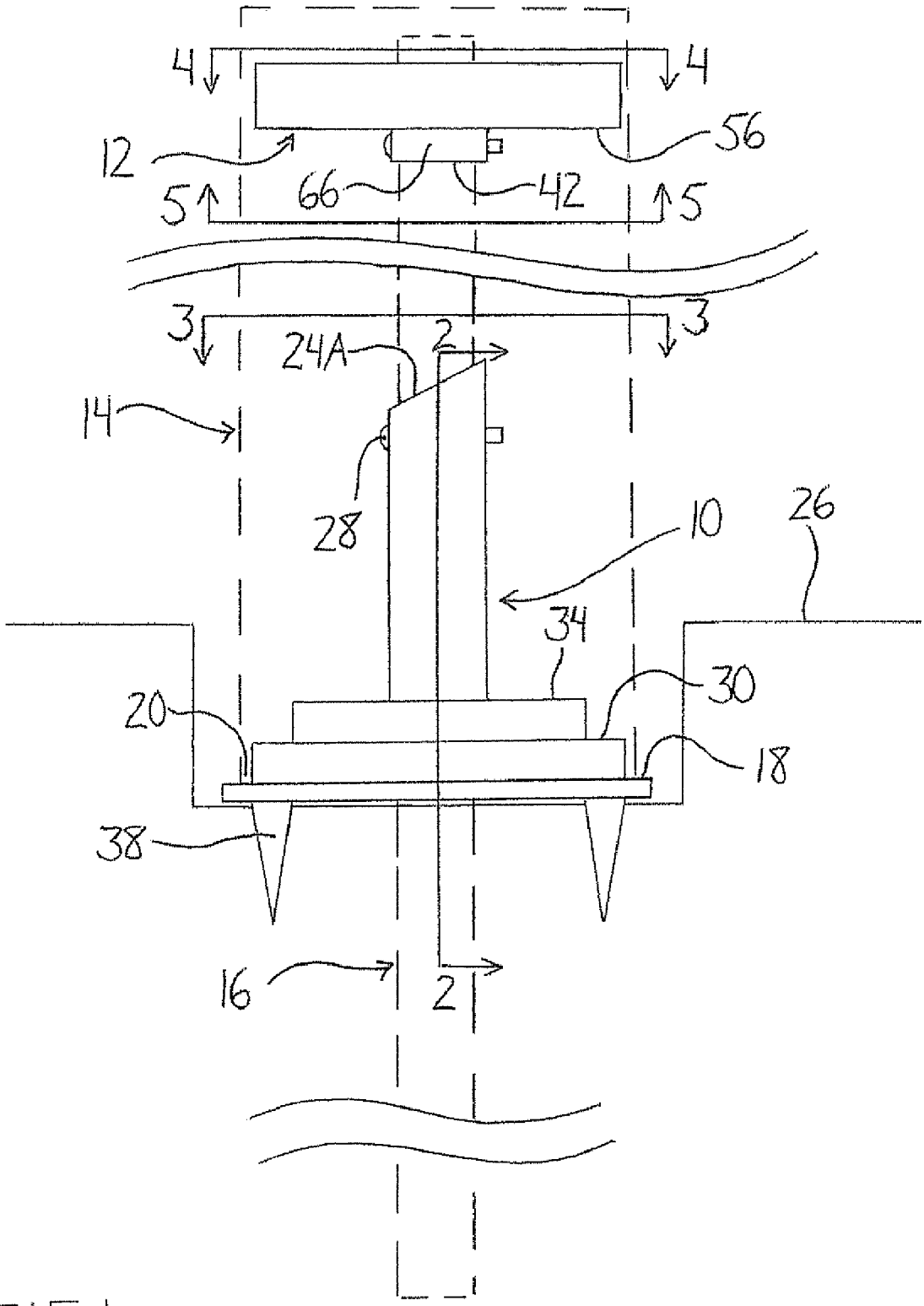
FIG. 1 is a side elevational view of a first embodiment system for mounting a hollow post about a pipe, the system having upper and lower mounting devices and the ground being cut away to aid in illustration of the lower mounting device.

As shown in FIG. 1, a first embodiment system for mounting a hollow post about an upward extending pipe features a lower mounting device 10 and an upper mounting device 12. The lower mounting device 10 defines a base on which the hollow post, represented by broken lines generally indicated at 14, rests when lowered over the pipe, represented by broken lines generally indicated at 16. The lower mounting device 10 is movable up and down along the pipe 16 before being fastened thereto such that an installer can adjust the height at which the hollow post 14 is disposed. The upper mounting device 12 allows adjustment of an angle between longitudinal axes of the pipe 16 and hollow post 14 to allow vertical alignment of the post even if the pipe 16 is not installed in perfect vertical orientation. The upper mounting device of the first embodiment allows adjustment of this relative tilt after installation of the hollow post without requiring removal thereof from about the pipe to re-expose the upper mounting device 12 for access thereto.

The lower mounting device 10 features a flat base plate 18 having an outer dimension greater than that of the hollow post 14, such that a lower end 20 of the post can sit upon the base plate 18. A pipe-receiving hole 22 is provided centrally in the base plate 18 to allow the pipe 16 to be passable through the lower mounting device 10. A pipe collar 24 extends perpendicularly upward from the base plate 18 from a central position about the pipe-receiving hole 22. The opening defined by the hollow cylindrical pipe collar 24 is in communication with the pipe receiving opening 22 such that, when passed through the lower mounting device 10, the pipe 16 is partially housed within the pipe collar 24. An inner diameter of the pipe collar 24 is substantially equal in size to an outer diameter of the pipe 16 such that the collar fits substantially concentrically thereabout.

In the figures, the pipe 16 is shown as being supported by having been driven into the earth to a depth beneath the ground surface 26. This method of anchoring a substantially vertical pipe for use in construction of a fence or other rail structure is well known to those of skill in the art. For use on a pipe installed in this manner, the lower mounting device 10 can be slid downward over the pipe 16 from an upper end thereof after being driven into the ground, or alternatively, the lower mounting device 10 can be pre-positioned on the ground to mark the desired position of the pipe 16 which can then be driven into the earth through the collar 24 and pipe receiving opening 22. Either way, the result is that the lower mounting device is disposed about the pipe 16 near the ground surface 26. An upper end 24A of the pipe collar 24 is cut at an angle in order to ease insertion of the pipe into the collar 24 from above when using the lower mounting device 10 as a position marker. The angled end 24A eliminates the need for perfect alignment of the pipe with the collar to initially feed the pipe into the mounting device in preparation for driving it into the ground.

With the lower mounting device being slidable along the pipe 16, it can be moved up and down therealong to dispose the base plate 18 at a height corresponding to a desired elevation of the bottom end 20 of the hollow post 14, at which time the device is fastened to the pipe 16. The result of this relative movement between the two components is the elimination of dependence of the hollow post height on the ground surface 26. The lower mounting device 10 may be mounted to position the base plate 18 at, above or below ground surface 26. In the figures, the base plate 18 has been disposed below ground surface 26 by digging out earth around the pipe 16 to a depth of a couple of inches and fastening the device 10 to the pipe 16 with a screw 28 passed through the collar 24 and pipe 16. Disposed below the ground surface 26, the lower end 20 of the hollow post 14 is hidden from sight while the base plate 18 defines a flat support surface for the hollow post regardless of irregularities in the recess dug into the earth.

The adjustability of the height at which the hollow post 14 sits simplifies installation of a horizontal rail structure in areas where there are irregularities or deviations from the horizontal in the ground surface 26. The heights of neighbouring posts, for example during installation of a fence, can be determined and matched before the post is even placed over the pipe 16 by using a straight line or laser level to position the lower mounting devices of the neighbouring posts at the same elevation, i.e. in a common horizontal plane. This will ensure that rails installed to extend between the posts will have a visually appealing horizontal orientation that can be provided over the full length of the fence, regardless of ground contours. Using the positionability of the lower mounting device 10 along the pipe 16 to define the level at which the base plate 18 is supported facilitates quick and easy adjustment of post heights in, for example, fence construction.

An outer annular wall 30 extends upward from the base plate 18 concentrically about the pipe-receiving opening 22 and pipe collar 24 to act as a post-engaging mechanism for positioning the hollow post 14 about the pipe 16. The outer annular wall 30 is sized such that an outer surface thereof frictionally engages interior wall surfaces of the rectangular hollow post 14 when its lower end 20 is lowered onto the base plate 18. A similar inner annular wall 34 having an outer surface 36 is provided concentrically between the pipe collar 24 and the outer annular wall 30. The inner annular wall 34 is provided to act as another post-engaging mechanism for engaging a smaller hollow post. In this embodiment, the post-engaging mechanism defined by the outer annular wall 30 is sized to engage a hollow post having outer dimensions of five inches square, while the other post-engaging mechanism defined by the inner annular wall 34 is sized to engage a hollow post having outer dimensions of four inches square. As a post of rectangular cross section having outer dimensions of four inches by four inches will not fit within the annular spacing between the inner and outer annular walls, the inner annular wall 34 extends upward from the base plate 18 farther than the outer annular wall 30 such that the four by four inch post sits atop the outer annular wall 30 when engaged by the inner annular wall 34. These sizes were chosen based on dimensions of hollow posts commonly used in fencing applications. Having the two post-engaging mechanisms allows use of the same lower mounting device 10 for constructions using either of these two common post sizes. It should be appreciated however that alternate embodiments may be provided having a single post-engaging annular wall dimensioned to engage only a single size of hollow post.

The pipe collar 24 extends a significant distance upward from the post-engaging annular walls 30, 34 to provide an area that is not blocked for access thereto in a radial direction. This provides room to facilitate easy fastening of the mounting device 10 to the pipe, for example sufficient room to easily accommodate an electric screwdriver for attachment of the collar 24 and the pipe 16 by the screw 28. Even if the base plate 18 is disposed below the ground surface 26, for example a few inches therebelow, the pipe collar 24 extends sufficiently to provide an easily accessible anchoring point above the surface 26.

The lower mounting device 10 also features an earth-engaging mechanism in the form of earth-piercing spikes 38 extending downward from the base plate 18 at points radially outward from the pipe-receiving opening 22. The figures show two spikes 38 diametrically opposed on the base plate 18, but it should be appreciated that additional spikes may be included so long as they are spaced radially outward from the pipe-receiving opening so as not to interfere with passage of the pipe 16 therethrough. When using lower mounting devices as pipe position markers during installation of pipes, the spikes 38 can be driven into the ground to ensure that the devices remain in place until the pipes have been anchored in their respective positions in the pipe-receiving openings of the devices. Furthermore, the spikes 38 may extend into the ground to further stabilize a lower mounting device 10 fastened to its respective pipe 16 to resists unwanted movement of the base plate 18 on which the hollow post 14 sits.

The upper mounting device 12 is disposed on the pipe 16 a distance upward from the lower mounting device 10 in order to engage the hollow post 14 closer to an upper end 40 thereof and hold it in a certain position about the pipe 16. It is desirable to allow adjustment of such an upper mounting device so as to be able to change this position of the post 14 relative to the pipe 16 at the upper end 40. It should be appreciated that the pipe 16 may not have been installed so as to extend in a completely vertical manner, but that supporting the post 14 about the pipe 16 with a relative degree of tilt between them may allow the post 14 to be supported in a vertical manner without having to first reorient the pipe 16. After installation of the upper mounting device 12 and the hollow post 14 around the pipe 16, if it is found that further adjustment is necessary as the hollow post 14 is not quite vertical, the upper mounting device 12 of the first embodiment allows such adjustment without having to substantially remove the hollow post 14 to regain access to the device 12.

Figure 4:
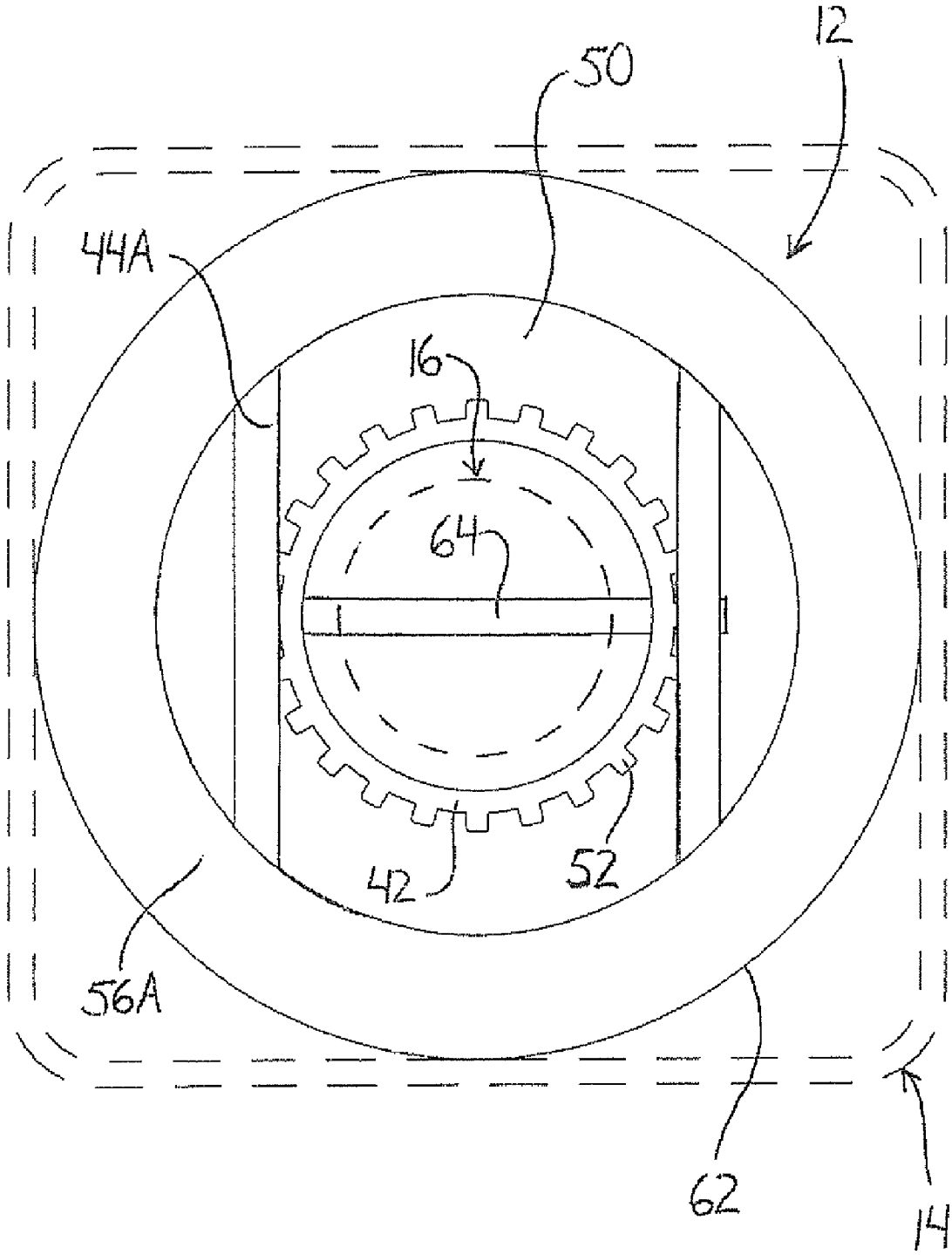
FIG. 4 is a top plan view of the upper mounting device as taken along line 4-4 of FIG. 1 with rings of the upper mounting device in a first engaged state.
Figure 5:
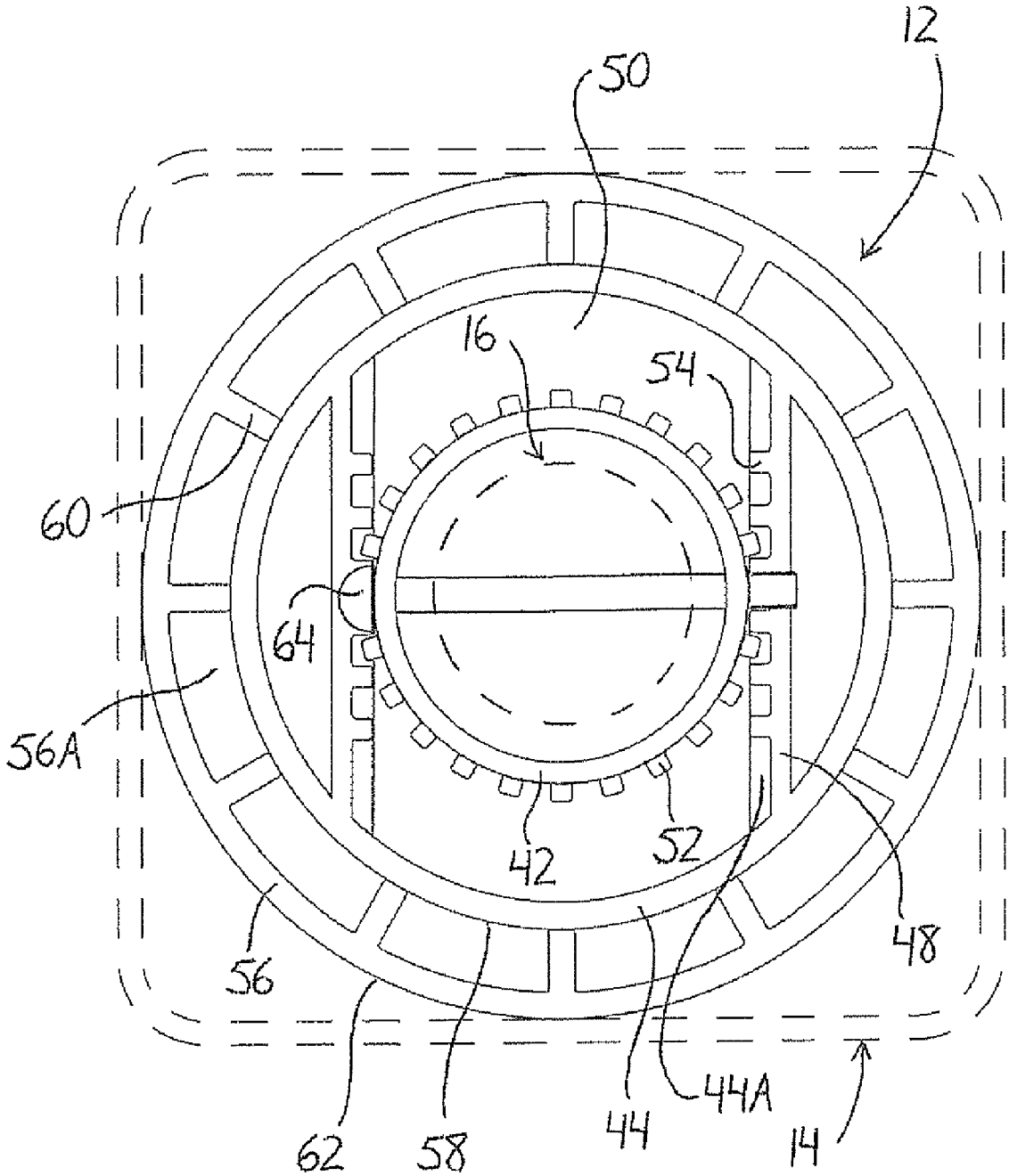
FIG. 5 is a bottom plan view of the upper mounting device as taken along line 5-5 of FIG. 1 with the rings of the upper mounting device in the first engaged state of FIG. 4.

The upper mounting device features a first, or innermost, ring 42 that can fit partly within a separate second ring 44 in a plurality of different engaged positions relative to thereto. The second ring 44 has two parallel chord elements 48 disposed symmetrically about an inner diameter thereof. A central opening 50 spanning the area between the chord elements 48 inside the second ring 44 is slightly wider, but substantially longer, than a diameter of the first ring 42. Teeth 52 spaced circumferentially around and extending radially outward from the first ring 42 engage with teeth 54 extending perpendicularly from the chord elements 48 into the central opening 50 defined partly thereby. This engagement of the teeth prevents relative motion between the first and second rings 42, 44 in a plane in which they lie when the first ring 42 is received in the central opening 50 of the second ring 44. It should be appreciated that as separate pieces, the first and second rings can be moved relative to one another without limitation upon removal of the first ring 42 from within the second ring 44 to an unengaged state. An outermost ring 56 is frictionally engaged to an outer surface 58 of the second ring 44 in a concentric manner by circumferentially spaced ribs 60 of equal length, each extending radially inward from the outermost ring 56. An outer surface 62 of the outermost ring 56 frictionally engages interior walls of the hollow post 14 so as to position them relative to the pipe 16, which is passed through the first ring 42. FIGS. 4 and 5 show the first and second rings 42, 44 in one engaged state in which the first and second rings are held concentric to one another such that the pipe 16 and hollow post 14 are concentrically positioned. This state would be suitable for use in the case where the pipe 16 is disposed vertically, making coaxial alignment of the post 14 to the pipe desirable.

Figure 6:
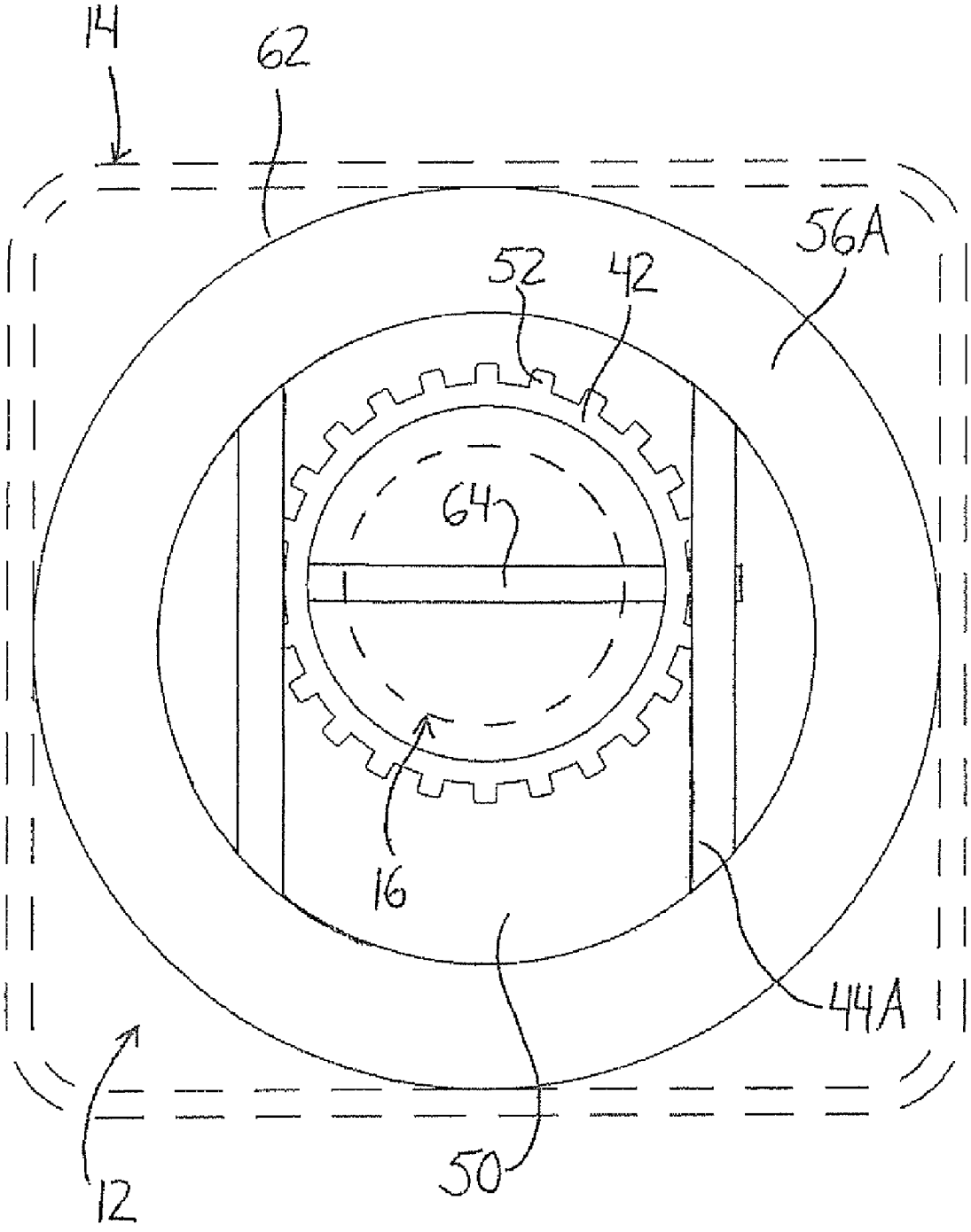
FIG. 6 is a top plan view of the upper mounting device of FIG. 1 with the rings of the upper mounting device in a second engaged state.
Figure 7:
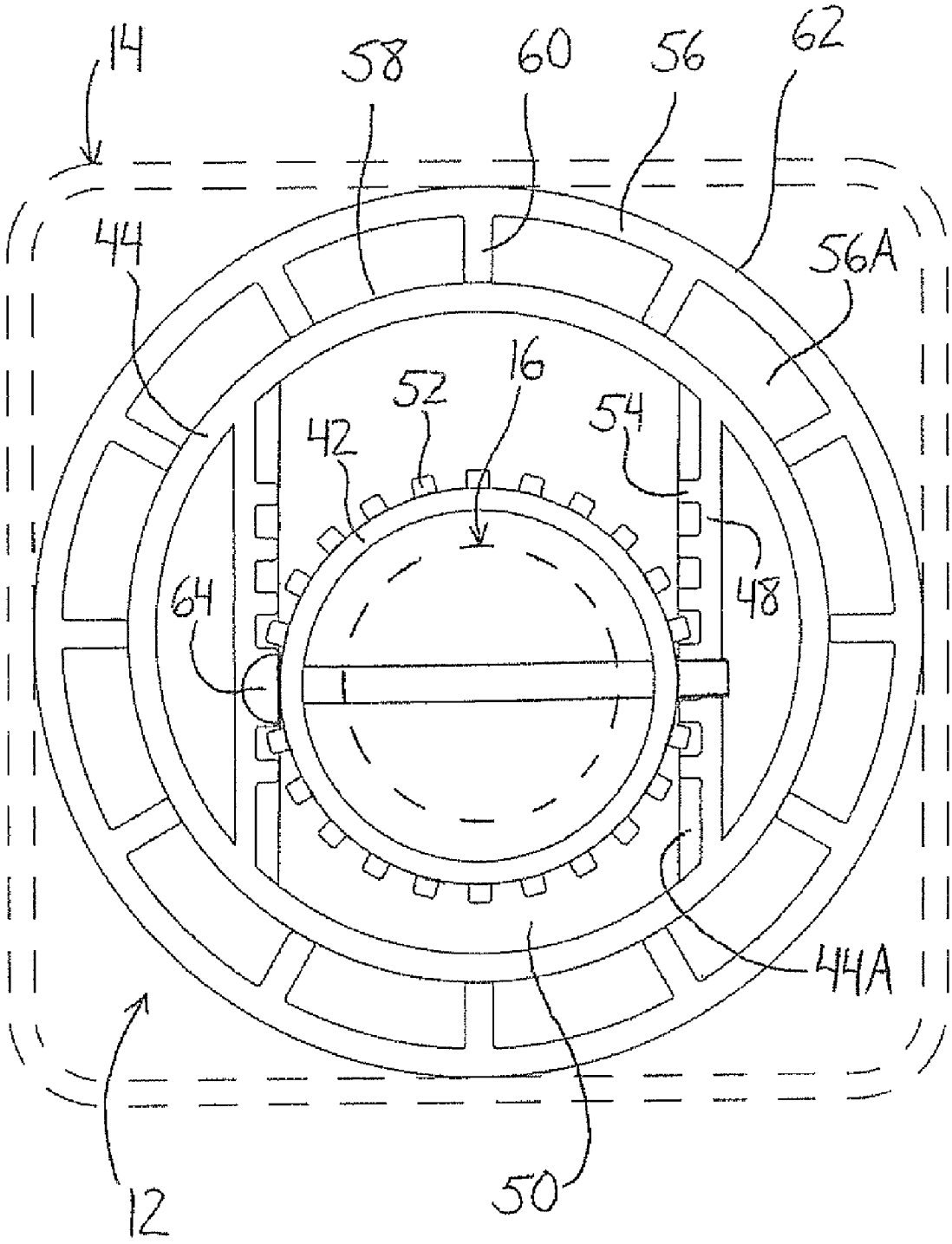
FIG. 7 is a bottom plan view of the upper mounting device of FIG. 1 with the rings of the upper mounting device in the second engaged state of FIG. 6.
Figure 8:
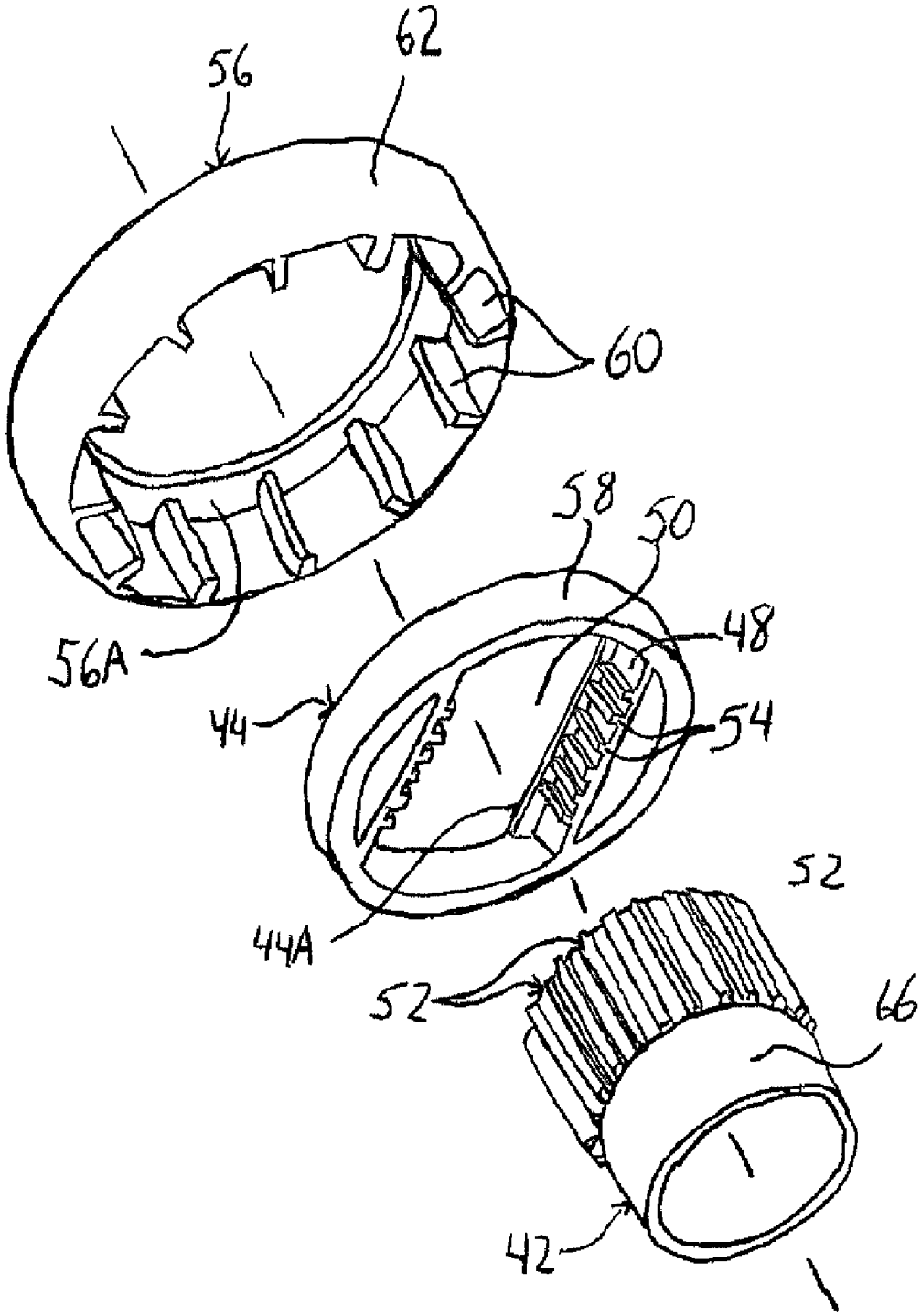
FIG. 8 is a perspective view of the upper mounting device of FIG. 1 with the rings of the upper mounting device in an unengaged state.

When the first ring 42 has been removed from inside the second ring 44 to an unengaged state, as shown in FIG. 8, the rings can be displaced relative to one another along the chord elements 48 so as to offset their axes. In the illustrated embodiment, five spaces between teeth 54 on each of the chord elements 48 correspond to five engaged states of the rings 40, 42, each state having a different respective position of the first ring 42 relative to the second ring 44. Each tooth on one chord element is aligned with a respective tooth on the other chord element along the length of these parallel chords of equal length, so that a receiving space defined between two adjacent teeth on one chord element aligns in the same manner with a respective receiving space defined at the opposite chord element. This pair of aligned receiving spaces allows for insertion thereinto of diametrically opposite teeth on the first ring, thereby defining a set of receiving spaces corresponding to a respective one of the different possible engaged states of the first and second rings. For example, the rings 40, 42 can be pulled out of the concentric engaged state shown in FIGS. 4 and 5, shifted relative to one another along the chord elements 48, and re-engaged into one of four eccentric engaged states as provided by the tooth spacing on the chord elements 48. FIGS. 6 and 7 show the rings 40, 42 in one of the engaged states in which the axis of the hollow post 14 is offset from that of the pipe 16 at the upper mounting device 12 due to eccentric positioning of the first ring 40 relative to the second ring 42.

With the rings installed, the teeth of each ring and the receiving spaces defined between adjacent ones of these teeth on the same ring extend axially along the pipe at linearly spaced positions along the plane perpendicular thereto. It will be appreciated that such axially extending receiving spaces may be defined on one of the ring-like members in an alternate embodiment by pairs of aligned linear holes extending into respective solid portions of this one member on opposite sides of the pipe receiving opening therein, with peg-like projections defined on the other ring-like member to project axially therefrom for insertion into any one of the multiple pairs of the receiving holes spaced along the member they extend into. The peg-like projections project from the one member for receipt in receiving spaces defined between features formed on the other member, just like the teeth of the illustrated embodiment, but project axially from the respective member, not radially or laterally therefrom. However, the use of radially outward projecting teeth on the first ring member of the illustrated embodiment formed over the full circumference thereof with inward projecting teeth linearly spaced along the second member allows for change of the in the horizontal direction along which the first and second rings can be shifted relative to one another before engagement by simple rotation of the second ring about the axis of its pipe receiving opening to engage its teeth with a different pair of diametrically opposite teeth on the first ring fastened to the pipe.

The second and outermost rings 44, 56 of the upper mounting device 12 correspond to the inner and outer annular walls 34, 30 respectively of the lower mounting device 10, in that their outer diameters are sized to frictionally fit different sizes of hollow posts. As an example, when using the inner annular wall 34 of the lower mounting device 10 with a 4-inch square hollow post, the outermost ring 56 of the upper mounting device is removed from the second ring 44, which is then used to frictionally engaged the interior surfaces of the 4-inch square hollow post.

The second and outermost rings 44, 56 feature respective flanges 44A and 56A which support them in a stacked arrangement atop the first ring 42 when in one of the engaged states. Each flange 44A of the second ring 44 is disposed along a respective one of the chord elements 48 above the teeth 54 thereon and extends into the opening 50 with the teeth 54. The result is that when the teeth 52 of the first ring 42 are disposed between the teeth 54 of the second ring in any of the engaged states, the flanges 44A sit atop the teeth 52 of the first ring 42 to support the second ring 44 thereon. The flange 56A of the outermost ring 56 extends radially inward along the circumference thereof a distance greater than the ribs 60. The flange 56A therefore rests atop the second ring 44 to support the outermost ring 56 thereon when the second ring is nested within the outermost ring. This reinforces the frictional fitting between the ribs 60 of the outermost ring 56 and the second ring 44 to ensure that the outermost ring 56 cannot be forced downward past the second ring 44.

With the lower mounting device 10 already disposed about and fastened to the pipe 16 at the desired height, the first ring 42 of the upper mounting device 12 is similarly slipped over the pole and fastened thereto, for example by a screw 64. As shown in the Figures, the screw 64 is passed through an untoothed portion 66 of the first ring 42 disposed below the teeth 52 thereof. This untoothed portion 66 extends downward from the second ring 44 when the first ring 42 is partially nested therein in any of the engaged states. Passing the screw 64 through the untoothed portion 66 thereby ensures that the screw will not interfere with engagement of the rings 42, 44 as provided by their teeth 52, 54. With the first ring fastened to the pipe, the second ring 44 is slipped over the first ring 42 into one of the engaged states with or without the outermost ring 56, depending on the size of hollow post being installed on the pipe 16. A level is then oriented to extend upward from one of the annular walls 30, 34 of the lower mounting device to the respective one of the second and outermost rings 44, 56 of the upper mounting device along where a wall of the hollow post would extend if installed to check if they lie in the same vertical plane. If they do not, then the second ring 44 is pulled upward off the first ring 42 to the unengaged state, shifted in a corrective direction as indicated by the level and lowered back onto the first ring 42 in a different engaged state. The level is then shifted ninety degrees to check alignment with another vertical plane perpendicular to the first and a similar corrective step is taken through adjustment between the rings of the upper mounting device if needed. It should be appreciated that relative rotation of the first and second rings 40, 42 of the upper mounting device 12 in the unengaged state will change the direction along which their axes are movable relative to each other, thereby allowing adjustment to compensate for lack of alignment to each of these perpendicular vertical planes. Once the upper mounting device has been adjusted to obtain verticality in each of the two perpendicular vertical planes, the hollow post 14 is lowered over the pipe 16 and upper mounting device 12 to engage the lower mounting device 10 and sit atop the base plate 18 thereof.

Having the upper mounting device 12 made of two disengagable components and having only one of them fastened to the pipe 16 facilitates simple adjustment of the hollow post 14 at a later date. For example, ground shifting may move the pipe 16 and cause the hollow post to become off plumb. Upper mounting devices of the prior art would, in such a case, likely require substantial removal of the hollow post from the pipe in order to allow access for adjustments. With the upper mounting device 12 of the first embodiment, the hollow post 14 only needs to be lifted enough to disengage the first and second rings 42, 44. The second ring 44, either directly or through the outermost ring depending on the size of post used, is frictionally engaged to the hollow post 14 after initial installation thereof. As a result, lifting of the hollow post 14 mere inches will disengage the first and second rings 42, 44 and allow relative shifting therebetween to realign the hollow post with vertical, at which point the post 14 can simply be lowered back onto the base plate 18 of the lower mounting device 10 to re-establish nesting of the first and second rings of the upper mounting device in a different engaged state. It should be appreciated that this adjustment requires significantly less effort than removing the hollow post entirely from the pipe, unfastening the upper mounting device from the pipe, adjusting the position of the upper mounting device relative to the pipe, refastening the upper mounting device and reinstalling the hollow post over the pipe.

The first embodiment allows fast and easy installation and adjustment of a plastic or vinyl rail structure, such as a fence. Lower mounting devices 10 are spaced apart along a straight line according to the length of rails that will eventually connect the posts and anchored to the ground by their spikes 38. Pipes 16 are then driven into the ground through the pipe-receiving openings of the lower mounting devices. Based on fluctuations in ground level over which the fence will eventually extend, a suitable height for a horizontal base level is chosen. A straight line or laser level is used to adjust the lower mounting devices of neighbouring posts such that their base plates 18 are supported at this level, and their pipe collars are fastened to the pipe. The elevation of the posts to be mounted will be equal along the length of fence, resulting in a visually pleasing horizontal fence. Used on a standard conventional fencing pipe not having any preformed or factory-installed features or mechanisms for securing the post, the height at which each device is installed on the pipe is selectable independent of the other and independent of where along its length the pipe connects to the ground, thus giving user, owner or installer control or selectability over the height of the post's final position set by positioning of the lower mounting device along the pipe axis by the installer. Before the posts are installed however, the first rings 40 of upper mounting devices 12 are fastened on the pipes 16 at a distance upward from the lower mounting devices, near where the top of the posts will eventually be disposed and the second rings 42 are lowered onto the fastened first rings 40. A level is used to establish vertical lines upward from an outer surface of an annular wall of the lower mounting device and the upper mounting device is adjusted such that an outer surface of its corresponding ring is substantially flush with said lines. The hollow post 14 is then lowered over the pipe 16 and upper mounting device 12 and engaged to the lower mounting device 10. Further adjustment of relative positioning between a post and the respective pipe can be achieved by simply lifting the post 14 upward to disengage the first and second rings 40, 42 of the upper mounting device 12, shifting the post and second ring relative to the pipe and first ring and lowering the post back onto the base plate 18 to engage the first and second rings in a different relative position.

If the outermost surface of the upper mounting device 12 is not situated far enough outward from its central axis within suitable tolerances to provide a secure enough frictional fit against the inner surface of the hollow post to allow lifting of the second ring from its position atop the first ring by mere lifting of the hollow post, it will be appreciated that the upper mounting device still simplifies adjustment relative to the prior art, as after the hollow post is lifted out of place, no manipulation of fasteners is necessary to separate the first and second rings into the unengaged state for relative shifting to establish a new post position. The second ring is simply manually lifted out of the previous engaged state atop the first ring and horizontally translated or rotated and set back down into engagement with the first ring in a new position or orientation relative thereto in the plane perpendicular to the pipe.

The first embodiment system of the present invention allows quick and easy construction of, for example, a fence that extends horizontally over its entire length by allowing sliding height adjustment of the base on which each post is supported and mounting of the base with a conventional fastener, such as a screw. Further adjustment of a posts toward a vertical orientation after its initial installation is simple due to the lack of need for access to the upper mounting device or lack of tools necessary for adjustments thereof. Each of the mounting devices are fastened to the pipe within the hollow post and do not use any fasteners passed through the hollow post, thereby providing a post assembly having a clean, unblemished appearance. It will be appreciated however that a the second ring may be fastened to the hollow post to ensure a stable installation, for example by a screw fed inward through the post into the second ring, once the upper mounting device has been used to obtain a satisfactory final orientation of the post.

In an alternate embodiment of the system, not illustrated in the figures, the lower mounting device has a similar structure to the upper mounting device as described above, but with the addition of a base plate to the bottom of the first ring extending outward from the opening therethrough. Here the first ring forms part of the pipe collar slidable along the pipe to a predetermined height for fastening thereto so as to define the height of the base plate on which the post can be seated. With the first ring so fastened, it can be engaged with the second ring in one of the plurality of engaged positions relative thereto corresponding to a desired position of the hollow post about the pipe near the bottom end of the hollow post. This allows quick and easy adjustment of both the height of the base on which the post rests and the position of the axis of the post relative that of the pipe near the base.

Figure 9:
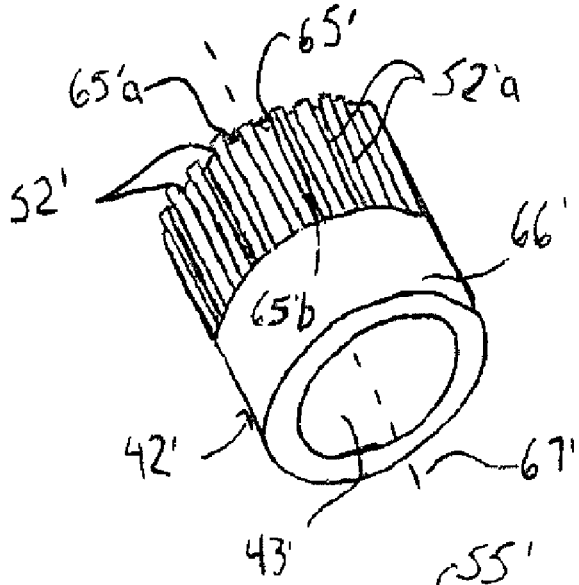
FIG. 9 is a perspective view of a first ring of a second embodiment upper mounting device.
Figure 10A:
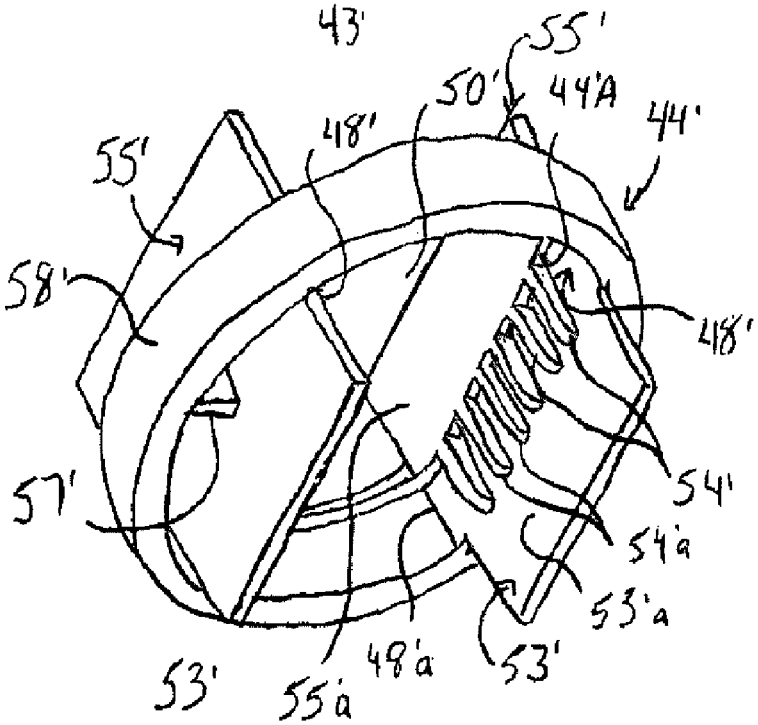
FIGS. 10A and 10B are perspective and side elevational views respectively of a second ring of the second embodiment upper mounting device for selective cooperation with the first ring of FIG. 9.
Figure 10B:
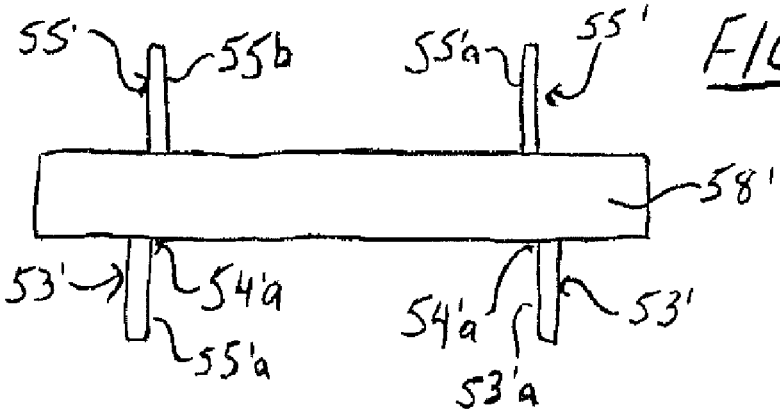
Figure 11A:
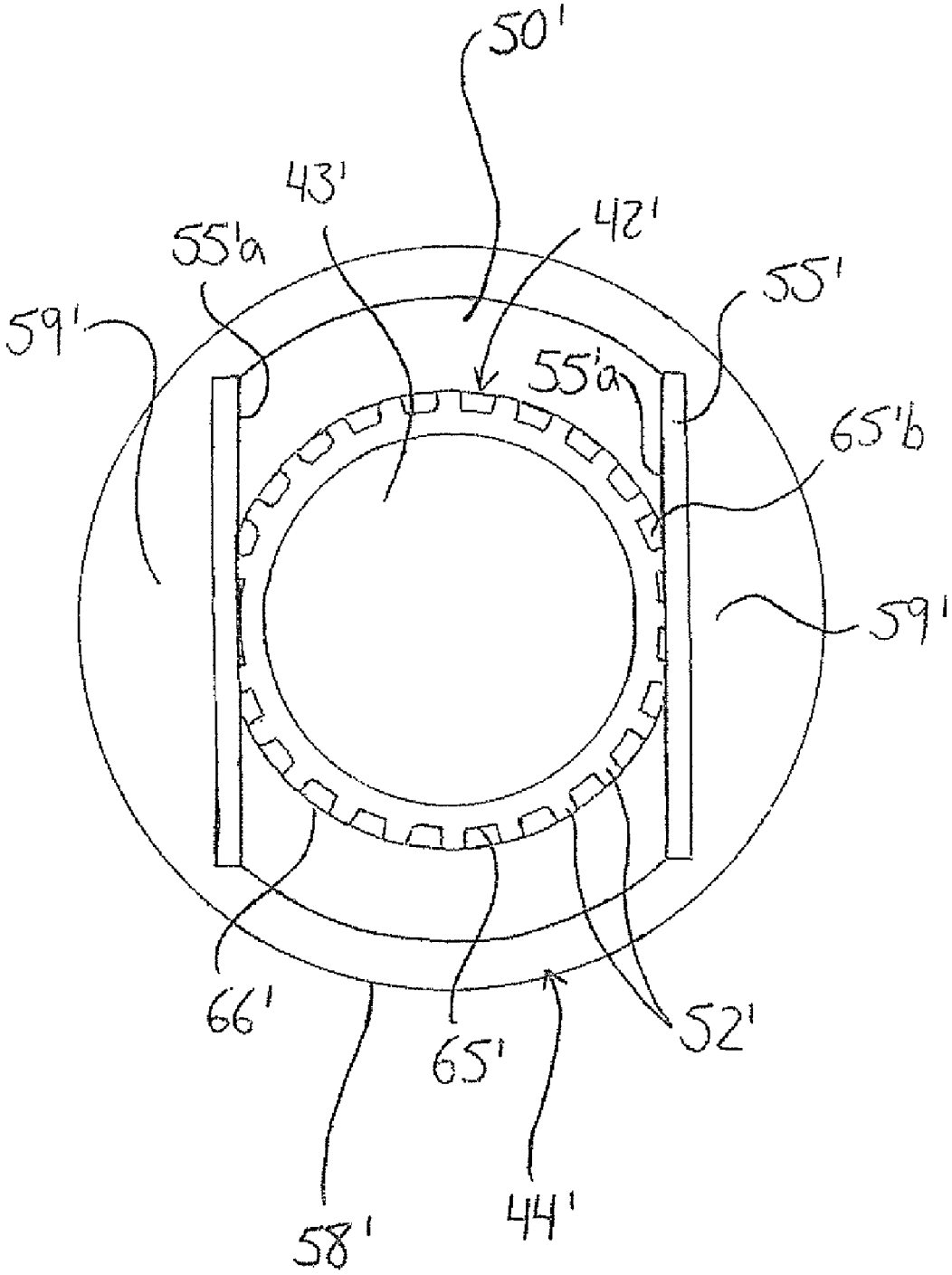
FIGS. 11A and 11B are top and bottom plan views respectively of the first and second rings of FIGS. 9 and 10 in an engaged state.
Figure 11B:
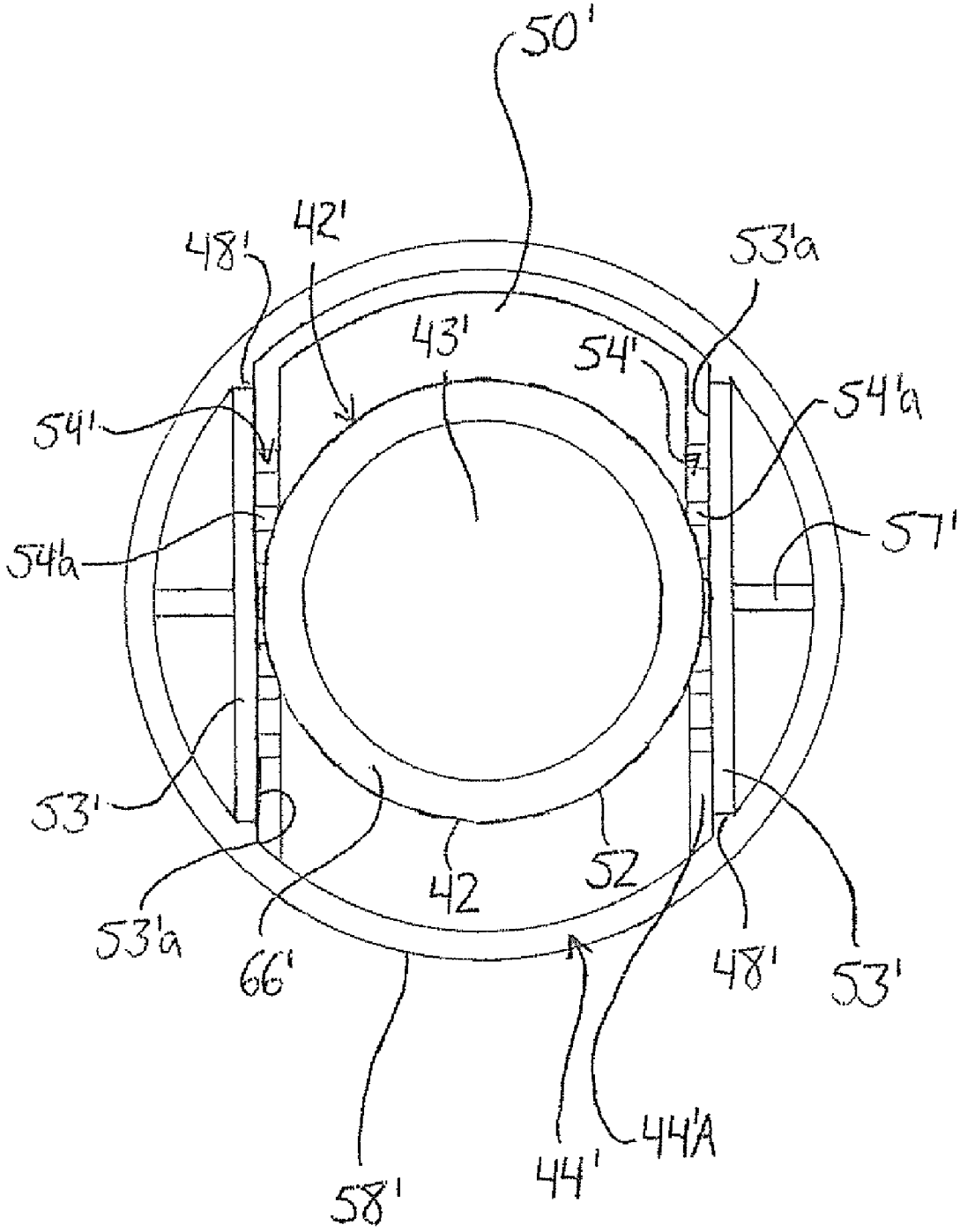

FIGS. 9 to 11 show a second embodiment of the upper mounting device. The first, or innermost, ring 42' is similar to that of the first embodiment in that a lower end portion 66' of the ring's hollow cylindrical body is untoothed, while an upper portion features a plurality of teeth 52' of generally rectangular cross section spaced circumferentially thereabout, each tooth 52' protruding radially outward and extending parallel to the ring's linear central axis. The first ring 42' is different from that of the first embodiment in that the toothed portion and untoothed portions are not defined by a continuous outer surface of a hollow cylindrical body having the teeth protruding radially outward from the outer surface at the toothed portion. Instead, as seen in FIGS. 9 and 11, the untoothed portion 66' of the first ring 42' has an outer diameter greater than that of the toothed portion 65' with the teeth 52' protruding radially outward therefrom. The distance the teeth 52' radially protrude from the outer surface of the toothed portion 65' is such that a radially outermost surface 52'*a* of each tooth 52' is generally flush with the outer surface of the untoothed portion 66'. The first ring 42' therefore has an overall outer diameter that is generally equal along its length (said length being measured along the central axis 67' about which the ring closes), unlike the first ring 42 of the first embodiment in which the outer diameter defined by the radially outermost surfaces 52*a* of the teeth 52 is greater than that defined by the untoothed portion 66 of the hollow cylindrical body. The hollow interior 43', or bore, of the first ring 42' is of constant diameter along the ring's length to ensure a consistent fit about the pipe.

The second ring 44' of the second embodiment upper mounting device is similar to that of the first embodiment in that it features two parallel chord elements 48' disposed on opposite sides of a central axis about which the ring closes, thereby forming a central opening 50' between the chord elements 48' that is approximately equal in width or only slightly wider than the outer diameter of the first inner ring 42'. Teeth 54' protrude perpendicularly from each of the chord elements 48' into the central opening 50' such that when the first ring 42' is partially nested into the central opening 50' of the second ring 44', the teeth 52' of the first ring 42' fit between the teeth 54' of the second ring 44' so that the engagement of these teeth prevents motion between the rings in a plane normal to their axes. In other words, the two rings cooperate in the same manner as in the first embodiment.

The second ring 44' differs from that of the first embodiment in that it is provided with thin flat walls extending parallel to the central axis about which the ring closes which allow fastening of the second ring 44' directly to the pipe. In other words, the construction of the second ring 44' of the second embodiment can be used with or without the first ring 42'. The same part can therefore be manufactured for alignment adjustable post mounting systems having a two-part upper mounting device or lower priced single-part upper mounting device, thereby saving production costs when making both systems, for example by reducing the number of distinctive molds required to produce both types of systems.

A first pair of walls 53' project downward from a bottom side of the second ring 44' on opposite sides of the central opening 50' therein, one from each of the chord elements 48'. Extending along the chord elements 48' and projecting therefrom, with the surface of each chord element 48' facing the opposite chord element being flush with the inner surface 53'*a* of the respective wall 53' facing the opposite wall, positions the walls 53' close enough together to be in close proximity to the pipe when the second ring is installed thereabout engaging the interior of the hollow post while being spaced apart enough to receive the first ring 42' between them for engagement of the teeth 52', 54'. With the inner surfaces of the chord element 48' and the wall 53' being flush, the teeth 54' may extend past the chord element 48' below the ring body to their distal ends 54'*a* while still being disposed on the common surface defined by the chord and wall.

A second pair of walls 55' project upward from a top side of the second ring 44' generally opposite the first walls 53' on opposite sides of the central opening 50'. The second walls 55' are not exactly opposite the first walls 53' however, as they project from and extend along the flanges 44'A defined at the upper ends of the chord elements 48' to project slightly into the opening 50'. It is from these flanges 44'A that the teeth 54' of the second ring 44' extend along the inner surface 48'*a* of the chord elements 48', just as in the first embodiment. However, in the second embodiment, the length of the teeth 54' of the second ring 44' relative to the teeth 52' of the first ring 42' will determine whether relative motion of the first ring 42' into the opening 50' of the second ring 44' during nesting is limited by engagement of an end 65'*a* of the toothed portion 65' of the first ring 42' opposite the untoothed portion thereof with the flange 44'A of the second ring 44' or by engagement of the distal ends 54'*a* of the teeth 54' of the second ring 44' with a shoulder 65'*b* of the first ring 42' defined by the difference in diameter between the toothed and untoothed portions 65', 66' thereof between adjacent teeth 52' of the first ring 42'. The inner surface 55'*a* of each wall 55' facing the opposite wall is defined flush with an end of the respective flange 44'A opposite the chord element 48' so that the walls 55' are close enough together to be in proximity to the pipe when the second ring 44' is installed thereabout engaging the interior of the hollow post while being spaced apart enough to receive the pipe between them. This spacing should be similar to the inner diameter of the first ring 42' which of course is also sized to fit about the pipe.

When the second ring 44' is used alone, it is lowered over the pipe so that the pipe passes through a passage defined by the space between the upper walls 55', the opening 50' through the ring body and the space between the lower walls 53'. With the opening 50' being greater in length than width in the plane perpendicular to the pipe, the second ring 44' can be slid relative to the pipe along the opening 50' to adjust the relative alignment between the central axis of the second ring 44' and the pipe to control the resulting alignment of the hollow post to be fitted over the ring. The walls 53', 55' provide points at which the second ring 44' can be secured directly to the pipe by passing fasteners such as screws through one or more of the walls, which as described above are in close proximity to the pipe the ring fitted thereover, into the pipe. This one-ring arrangement may not offer as tight a fit against the pipe as with the two-ring arrangement of the upper mounting device, but may be sold as a lower-cost alternative due to the fewer number of parts in the respective post mounting system and the costs saved by producing the same part for both systems. It should be appreciated that the outermost ring 56 of the first embodiment may be used with the second, or middle, ring 44' of the second embodiment to expand its effective size for use with hollow posts of larger cross section, just as taught for the first embodiment.

It should be appreciated that because engagement of the distal ends 54'*a* of the teeth 54' of the second ring 44' with the shoulder 65'*b* of the first ring 42' defined by the difference in diameter between the toothed and untoothed portions 65', 66' thereof between adjacent teeth 52' of the first ring 42' can act to support the second ring 44' when lowered over the first ring 42', the flanges 44'*a* are no longer necessary for this purpose as they were in first embodiment. However, including these flanges 44'*a* protruding into the opening 50' further than the teeth 54' allows placement of the fastener receiving walls 55' protruding upward from the ring body in the closest possible proximity to the pipe for the best possible fit of the second ring 44' thereto during use without the first ring 42'.

As shown in FIGS. 10 and 11, the strength of the second ring 44' may be improved by providing two radially extending ribs 57' at diametrically opposite points on the ring body, each extending inward therefrom toward the central opening 50' to connect to the respective chord element 48'. It should be appreciated that more than one rib may be provided for each chord element and that the ribs need not necessarily extend radially relative to the ring body. The strength and rigidity of the part is further improved from the first embodiment by providing webs 59' formed at the top surface of the ring body, each web 59' closing the space between the outer surface 58' of the ring body and a respective one of the walls 55' projecting thereabove while connecting to the respective chord element 48'.

Figure 2:
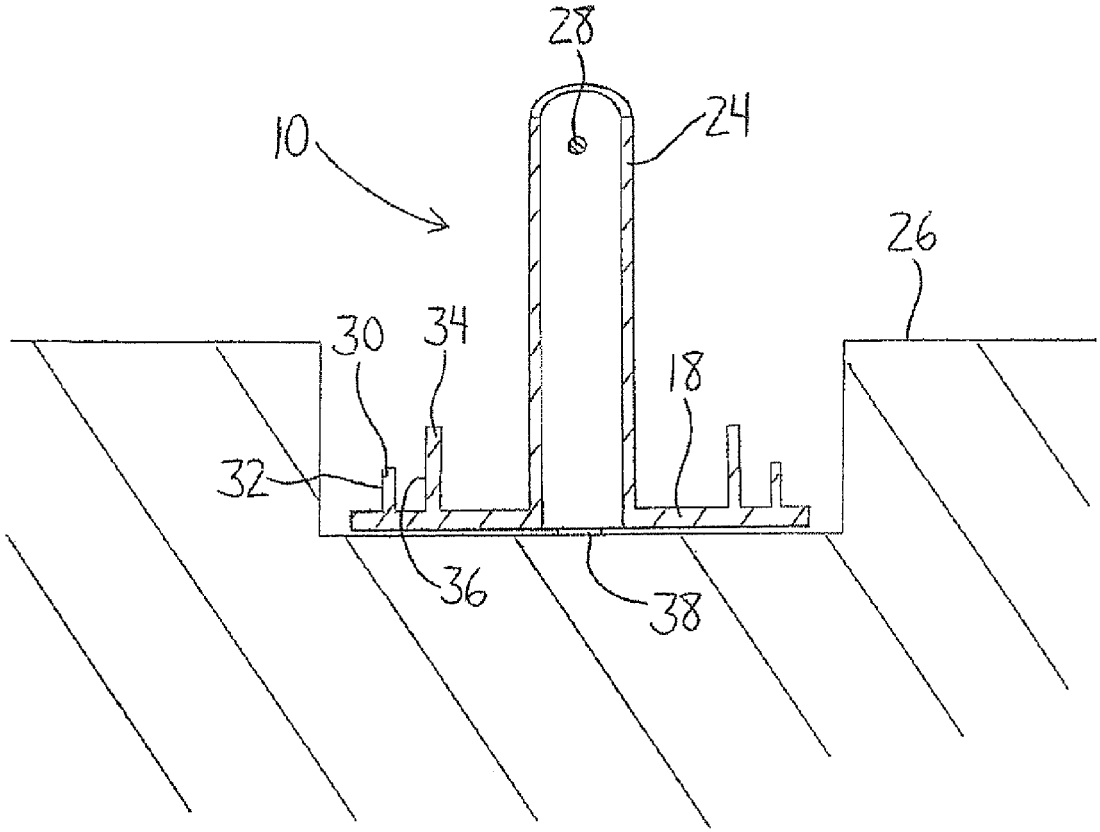
FIG. 2 is a cross sectional view of the lower mounting device as taken along line 2-2 of FIG. 1
Figure 3:
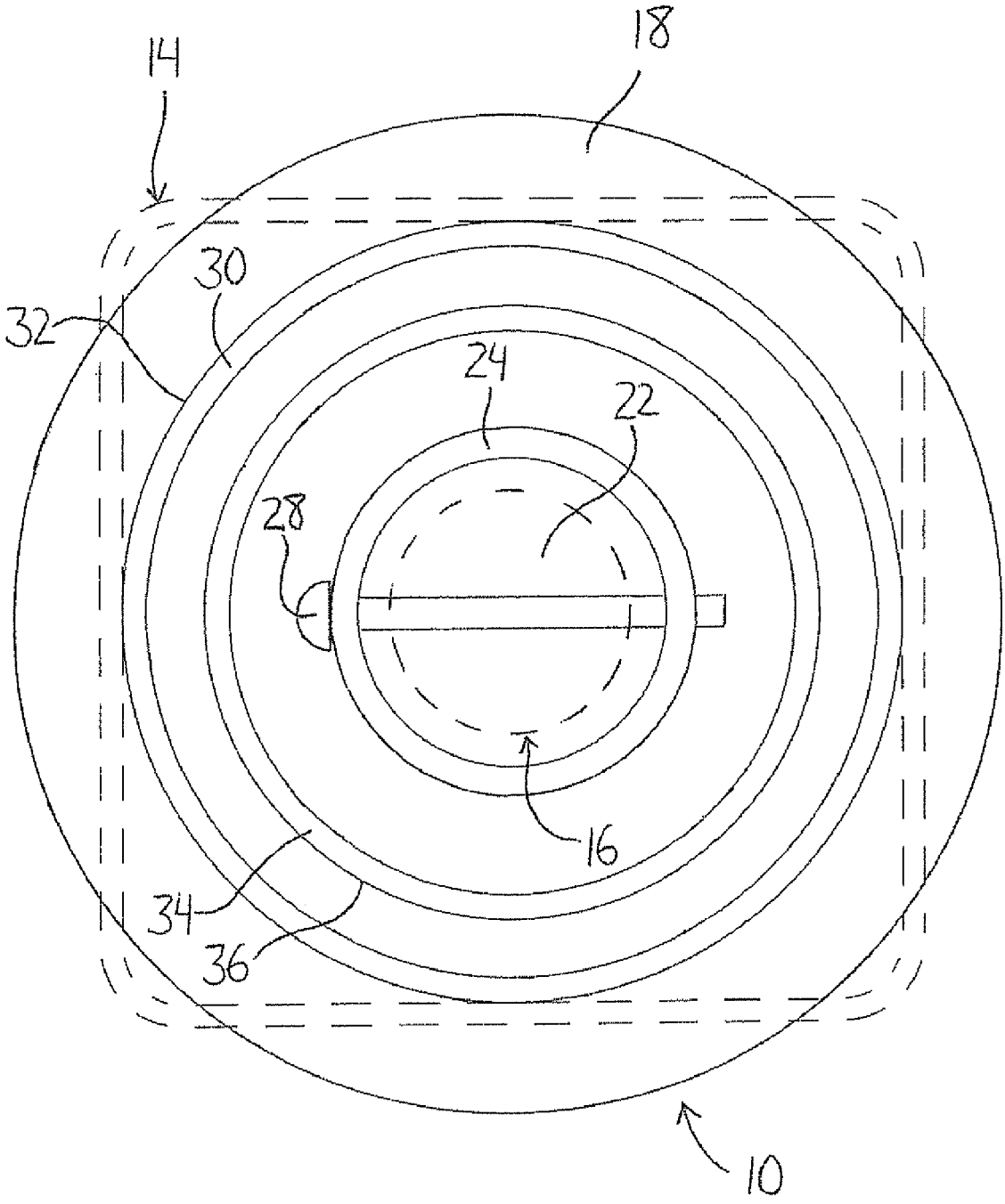
FIG. 3 is a top plan view of the lower mounting device as taken along line 3-3 of FIG. 1.
Figure 12A:
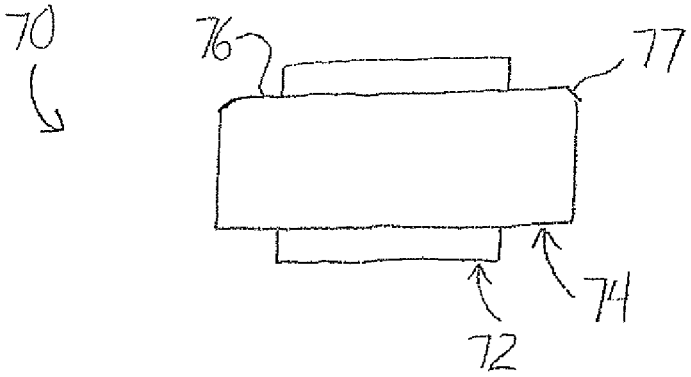
FIGS. 12A, 12B and 12C are side elevational, top plan and bottom plan views respectively of a third embodiment mounting device which can be used as an upper or lower mounting device in a system for mounting a hollow post about a pipe.
Figure 12B:
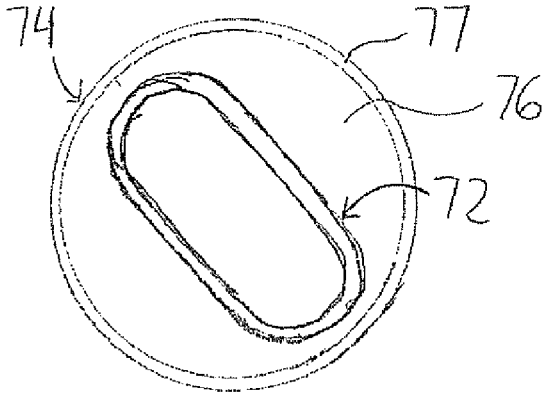

FIG. 12 shows a third embodiment mounting device 70 that can be used to position a hollow post 14 about a pipe 16. The device includes an inner cylinder 72 disposed concentrically within an outer cylinder 74. The two cylinders are attached to one another by a web 76 spanning the space between them at the upper end of the outer cylinder 74. Fins 78 also connect the two cylinders by extending radially between the inner surface of the outer cylinder 74 and the outer surface of the inner cylinder 72. Along the common axis of the two cylinders, the inner cylinder 72 is longer than the outer cylinder 74 and extends beyond both ends thereof. On its own, the mounting device 70 has similarities to the lower mounting device 10 described above and shown in FIGS. 1 to 3. The web 76 has a pipe-receiving opening therein as defined by the inner cylinder 72 which acts as the pipe collar. The outer cylinder 74 forms an outer annular wall sized to engage the inner surfaces of a hollow post lowered over it. The mounting device 70 differs in that it does not form a base on which the hollow posts can sit.

The inner cylinder 72 shown in the figures has its cross section elongated in one direction such that the width of the pipe-receiving opening is sized to fit snugly over the pipe but the length of the opening exceeds the pipe diameter. This allows misalignment of the longitudinal axis of the pipe and that of the mounting device (i.e. the common axis of the concentrically arranged cylinders), for example to facilitate a vertical hollow post orientation about a pipe somewhat tilted out of a vertical plane. The outer cylinder 74 is provided with an inward taper at its outer surface extending toward its upper end from a relatively short distance therebelow, resulting in a sloped surface 77 extending obliquely between the outer surface of the outer cylinder 74 and the outer, or upper, surface of the web 76. This facilitates sliding of the hollow post over the device without precision concentric alignment of the two beforehand. The extension of the inner cylinder 72 from both ends of the outer cylinder 74 allows fastening of the mounting device 70 to the pipe at the top, bottom or both ends of the device, as selected by an installer.

It should be appreciated that the mounting device 70 may be used to position a hollow post about a pipe at either of upper and lower positions thereon. However, as outlined herein above in the context of the first embodiment lower mounting device 10, there are advantages to providing a post-supporting base and ground-piercing spikes for use at the lower end of the pipe. FIG. 13 shows how the mounting device 70 can be easily adapted to include such features.

Figure 12C:
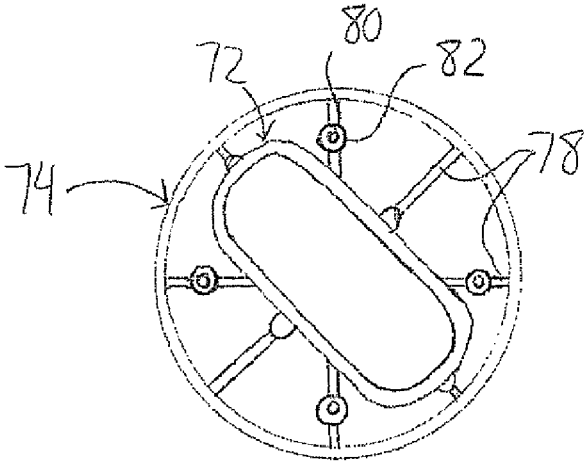
Figure 15:
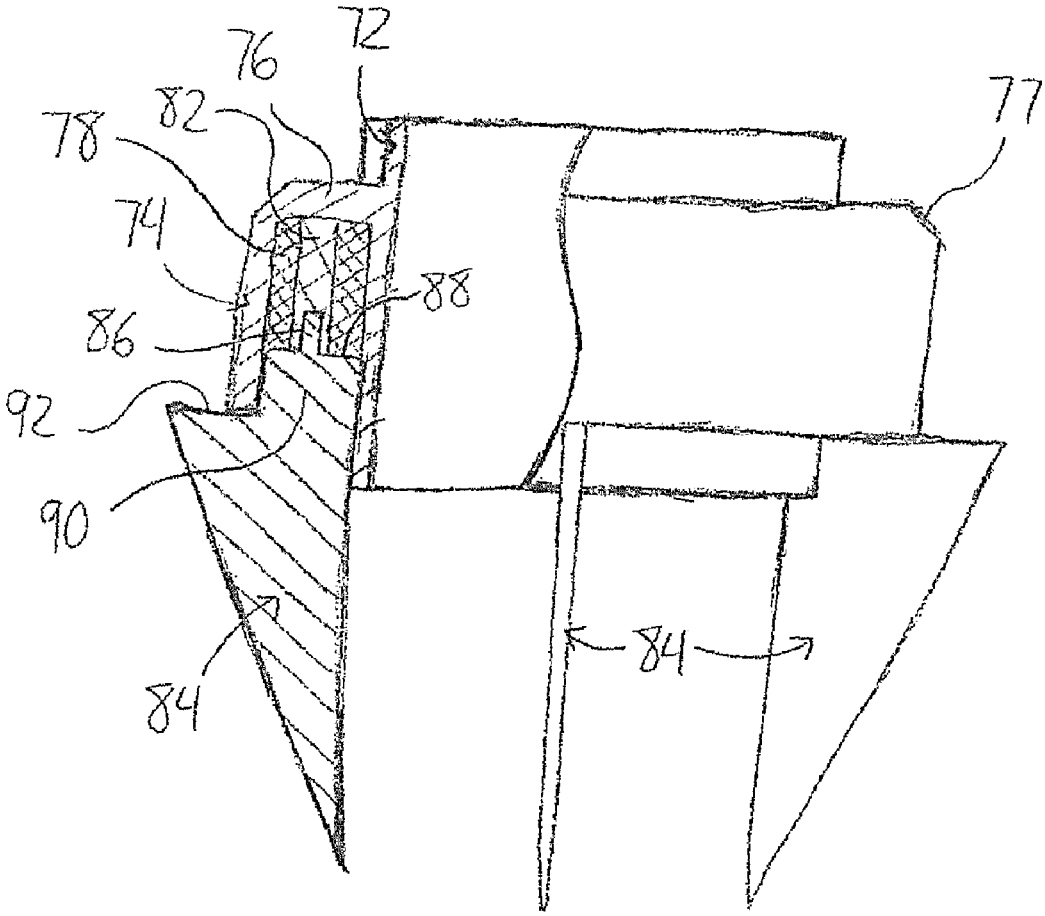
FIG. 15 is the view of FIG. 13A enlarged and partially cross-sectioned to illustrate connection between the third embodiment mounting device and the ground piercing spikes.

As shown in FIG. 12C, some of the fins 78 are provided with recesses 80 extending upward into the fins from the bottom thereof. Each recess 80 may be provided in a thickened portion 82 of the fin, for example of cylindrical shape of circular cross section having a diameter greater than the thickness of the remainder of the fin. Such construction uses less material than increasing the thickness of the fin over its entire length while ensuring sufficient wall thickness about the recess to provide strength for its intended purpose explained below. Ground piercing spikes 84, one of which is illustrated in FIG. 14, can be secured to the mounting device 70 by cooperating with the recesses in the fins.

Each spike 84 features a boss 86 extending upward from an upper edge 88 thereof sized to be received in the recess 80 of a respective fin 78 for frictional engagement therewith. In the illustrated embodiment, the fins 78 do not extend the full length of the outer cylinder 74 from the upper end thereof. Therefore, an upper portion 90 of the spike 84 defining the upper edge 88 is sized to fit in the space between the inner and outer cylinders. Below this upper portion 90, the spike 84 widens at a height therealong that corresponds to the bottom of the outer cylinder 74 when the boss 86 is fully received in the respective recess 80. This widening defines a ledge 92 that extends outward, with respect to the axis of the mounting device, past the outer cylinder 74. The ledges 92 of the spikes 84 disposed about the mounting device 70 form a base on which the hollow post can sit when installed over the device.

Provided with the base-defining spikes 84, the mounting device 70 can be used in the same manner as the lower mounting device 10, that is, fastened to the pipe 16 at the inner cylinder 72, for example by a screw, with the inner walls of the hollow post 14 being engaged by the outer cylinder 74 when the hollow post sits atop the base provided by the ledges 92 of the spikes 84. The mounting device 70 can thus form both the upper and lower mounting devices of a post mounting system, with the spikes 84 being addable to the lower mounting device to provide a post base and earth engaging elements.

The illustrated embodiment of the mounting device 70 has recesses 80 in four of its fins 78 angularly spaced equally about its axis and extending in a radial direction. Each spike 84 thus supports a respective side of the hollow rectangular post 14. Each spike-receiving fin is angularly spaced by forty-five degrees from length and width directions of the inner cylinder cross section such that the length of each spike receiving fin, as defined by the distance between the inner and outer cylinders at its angular position thereabout, is the same. The result is that each spike 84 is sized to properly mate with any of the spike receiving fins. Therefore, a system using the mounting device 70 in both upper and lower mounting positions on a pipe requires the manufacture of only two distinct parts: identical mounting devices and identical spikes.

The mounting devices 70 may be produced in the form of molded plastic or vinyl. It should be appreciated that the fins do not have to be radial with respect to the axis of the mounting device to nor equally spaced thereabout provide equally sized mounting positions for equally sized spikes. A base for supporting the hollow post attachable to the mounting device may be provided in a form other than spike-formed ledges. For example, a single annular ledge or flange may be fastenable, for example by snap fitting, to the fins to extend fully about the outer cylinder at the bottom end thereof. Different methods of fastening components together are known to those of skill in the art and may be applied to connect the mounting device 70 and spikes 84 or other base defining members. The inner cylinder need not extend from both ends of the outer cylinder. For example, the inner cylinder may extend only from the top of the outer cylinder, allowing connection to the pipe only above the post engaging walls of the outer cylinder.

Figure 16:
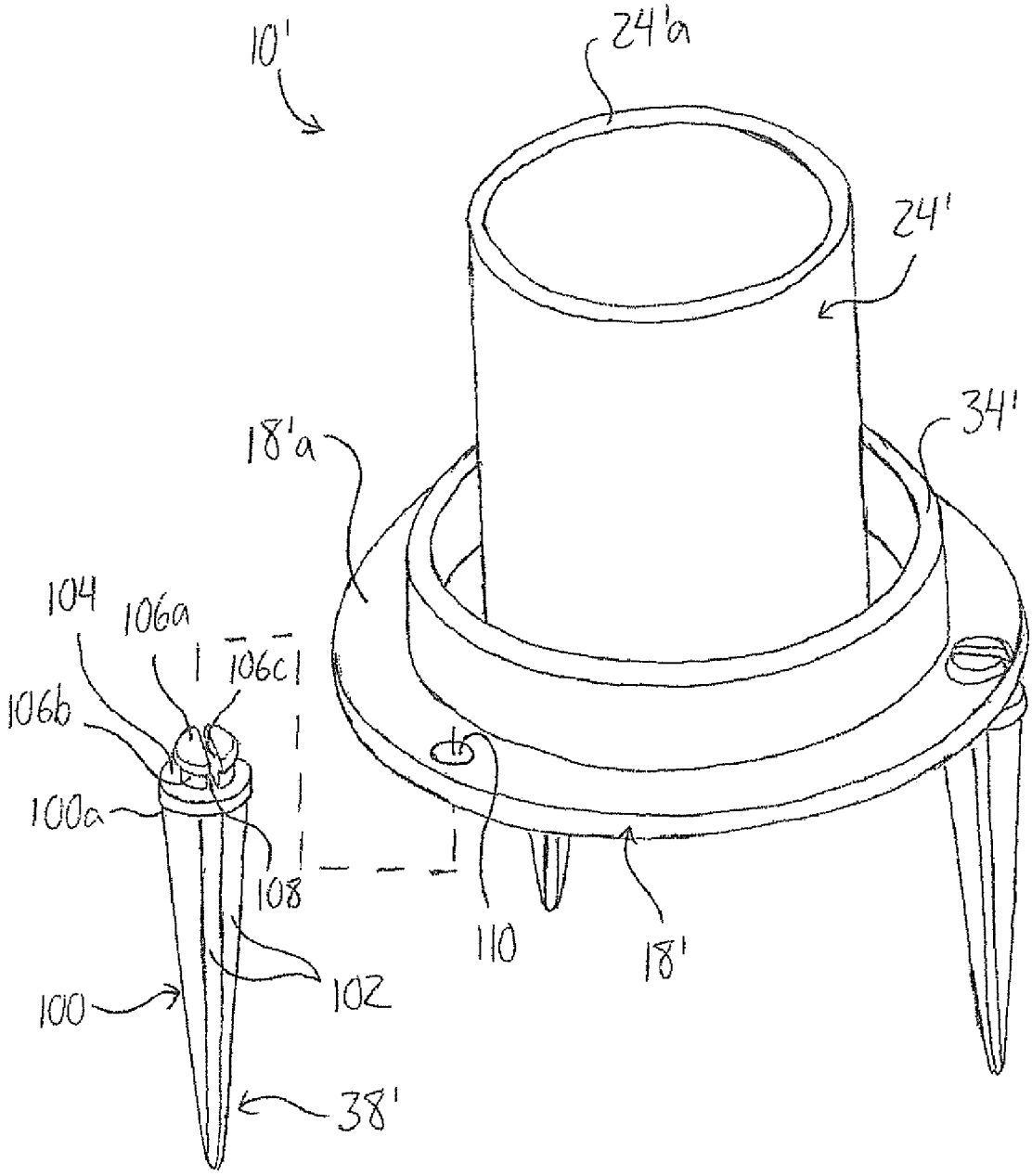
FIG. 16 is a partially exploded perspective view of a fourth embodiment lower mounting device.

FIG. 16 shows a fourth embodiment lower mounting device 10' similar to that of the first embodiment in that it features a base plate 18', a pipe collar 24' protruding perpendicularly upward from the base plate and communicating with a pipe-receiving hole centrally located in the base plate 18', and an annular wall 34' protruding upward from the base plate 18' to extend concentrically about the pipe collar 24'. The lower mounting device 10' differs from that of the first embodiment only in that the upper end 24'*a* of the pipe collar 24' is perpendicular to the axis thereof rather than being sloped relative thereto, only a single annular wall is provided to act as a post-engaging mechanism for only a single particular size of hollow post, and three spikes 38' are provided that are removably mountable to the base plate 18'.

Each spike 38' features a spike body 100 tapering from a top end 100*a* to a bottom end 100*b*. The spike body 100 has an X-shaped or cross-shaped in cross section, thereby defining four blades 102 protruding radially from a central longitudinal axis of the spike body 100 at equally spaced positions thereabout. A round ledge 104 formed atop the spike body 100 has two clip bodies 106 protruding perpendicularly upward therefrom, the two clip bodies 106 being slightly spaced apart by a narrow empty channel 108. A bottom portion 106*a* of each clip body 106 is a cylinder of semi-circular cross section extending upward from the ledge 104 with a semi-circular flange 106*b* disposed thereatop to extend radially beyond the semi-circular cylindrical portion 106*a* along the 180 degree curved portion thereof. This defines flat faces 106*c* of the clip bodies 106 facing one another that if not for the channel between them would fit together would mate to define a round cylindrical portion with a round flange thereatop. The clip bodies 106 are not rigid, but rather are flexible relative to the ledge 104 enough to be bent toward one another manually or with tools to decrease the distance spanned by the two flanges 106*b* about the longitudinal axis of the spike body 100. The clip bodies are also resilient so as to return to their original spaced apart positions, as shown in the figure, once the squeezing force is removed.

Holes 110 are circumferentially spaced about the base plate 18' of the lower mounting device 10', each sized and shaped to allow passage of the flanges 106*b* of the clip bodies 106 of a respective spike 38' to be passed upward through it from beneath the base plate 18' when the clip bodies are squeezed together. Once the flanges 106*b* pass through the hole 110 to above the top surface 18'*a* of the base plate 18', their resiliency forces them apart to their original positions in which the flanges 106*b* then extend beyond the limits of the hole 110. The base plate 18' surrounding the hole 110 is therefore sandwiched between shoulder's formed by the flanges 106*b* and the ledge 104 about the bottom portions 106*a* of the clip bodies 106. If it is desirable to remove the spike 38', then the flanges 106*b* can again be squeezed together to allow withdrawal from the base plate 18' through the hole 110.

The releasable clips formed at the top of the spikes allow installation and removal of spikes as desired by an installer. Spikes of different sizes and shapes are known and may also be arranged for selective mounting and removal to the base plate. Releasable fasteners other than those shown in FIG. 16 may be applied to allow connection to and removal from the lower mounting device.

Figure 17A:
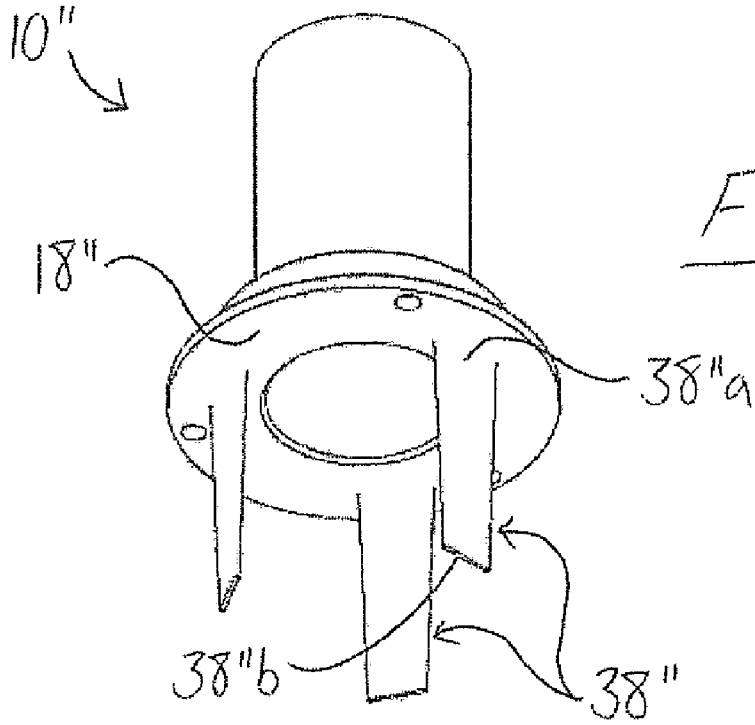
FIGS. 17A and 17B are perspective and side elevational views respectively of a fifth embodiment lower mounting device.
Figure 17B:
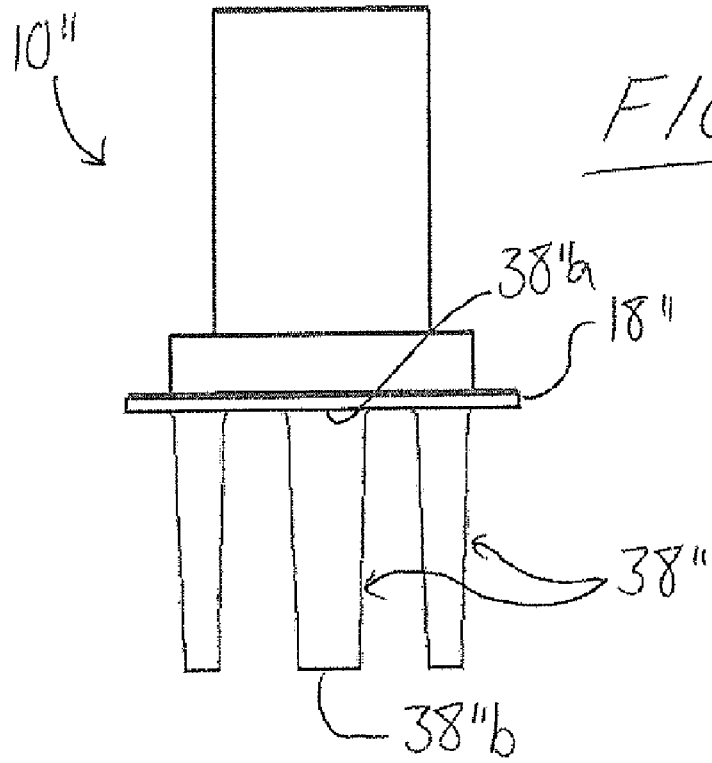

FIG. 17 shows a fifth embodiment lower mounting device 10" similar to that of the fourth embodiment in FIG. 16, except that the spikes 38" are formed as an integral part of the molded plastic or vinyl mounting device. In this embodiment, the spikes are of a single blade structure which tapers both in width and thickness from an upper end 38"*a* of the spike at the base plate 18" to a bottom end 38"*b* opposite the base plate, the bottom end defining a relative thin piercing edge sharp enough to sink into the ground. As illustrated by the various embodiments of lower mounting devices, the earth-piercing elements depending downward from the base may be provided in various shapes, sizes and mounting arrangements.

Figure 18A:
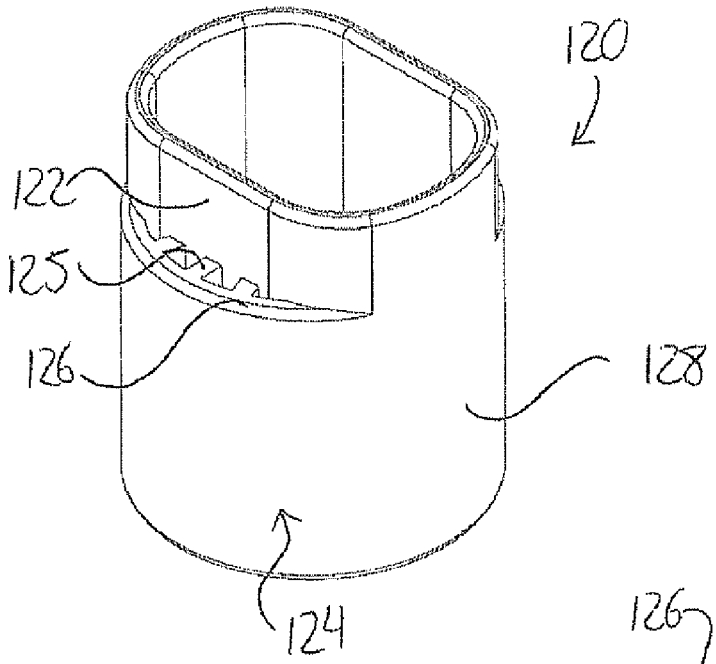
FIGS. 18A, 18B are perspective and top plan views respectively of a sixth embodiment upper mounting device.
Figure 18B:
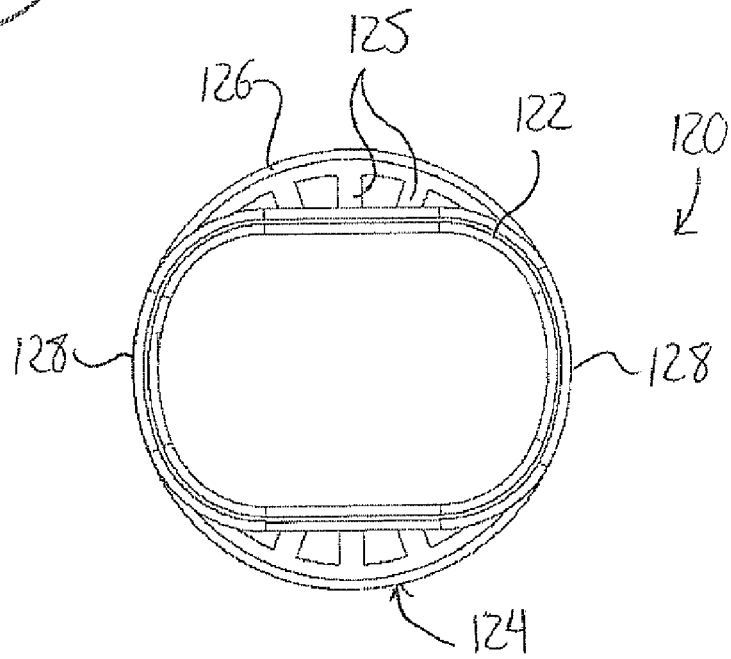

To illustrate that the upper and lower mounting devices of the various embodiments may be mixed and matched, FIG. 18 shows a sixth embodiment of an upper mounting device that can be used with any of the lower mounting devices described herein above to position a hollow post about a pipe in our out of alignment therewith. The upper mounting device 120 has some similarities to the third embodiment mounting device 70 of FIGS. 12 to 15. An inner hollow cylinder 122 has a hollow outer cylinder 124 extending concentrically thereabout with fins 125 extending radially between the inner surface of the outer cylinder 124 and the outer surface of the inner cylinder 122. The outer cylinder 124 has a round cross section, but the inner cylinder 122 has its cross section elongated to be just larger than the diameter of the pipe in width, but significantly larger than the diameter of the pipe in length. When placed over the pipe, this allows shifting relative thereto to control relative alignment between the pipe and the post to be placed over the mounting device. Not only does the elongated cross section of the inner cylinder allow adjustment of the relative alignment between the pipe and the post, but it also makes it easier to pass the device over any outer surface irregularities in the pipe that produce minor variations in the outer dimension thereof by reorienting the mounting device about the pipe to extend any protrusion from the pipes intended diameter in the longitudinal direction of the inner cylinder's cross section. The outer cylinder 124 is provided with an inward taper 126 extending toward its upper end from a relatively short distance therebelow.

The mounting device 120 differs from that of the third embodiment in that the inner cylinder 122 extends beyond only the top end of the outer cylinder 124 along the common longitudinal axis of the two, as fastening of the device to the post at both the top and bottom may not be necessary to provide adequate stability. No web spans from the upper end of the outer cylinder 124 to the inner cylinder exterior to close the space therebetween. The mounting device 120 is arranged for use with a post having a hollow channel therealong with a width that does not exceed the pipe diameter by nearly as much as the post for which the mounting device 70 is designed to fit. Therefore, to maximize the level of alignment adjustability between the pipe and post axes facilitated by the mounting device 120, the inner and outer cylinders 122, 124 share a common portion 128 of the outer cylinder's wall at each longitudinal end of the inner cylinder 122. In other words, the length of the inner cylinder 122 is equal to the diameter of the outer cylinder 124. With this relative sizing between the cylinders, the ribs 125 are therefore limited to positioning on opposite sides of the inner cylinder 122 between the longitudinal ends thereof. Providing a plurality of ribs 125 in the relatively small spacing on each side provides significant strength and rigidity even without a web. As the illustrated mounting device 120 is intended for use as an upper mounting device, no base or ground piercing spikes are shown.

It should be appreciated that the mounting devices of the present invention may be modified for use with pipes and hollow posts of different shapes and sizes. Furthermore, the devices may be used on pipes that are anchored to the ground by means known to those of skill in the art other than direct engagement with the earth. The upper mounting device may be used with lower mounting devices other than that of the present invention, just as the lower mounting device may be used with upper mounting devices other than that of the present invention. It should be appreciated that engagable members other than nestable rings may be used to provide the adjustability of the multi-pieced upper mounting device, for example non-nesting bodies using the axially extending peg and hole arrangement mentioned herein above in place of the tooth and slot arrangement illustrated.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for mounting a hollow post about a pipe, the method comprising the steps of:

(a) providing a lower mounting device having a pipe-receiving opening extending therethrough and a base defined outward from the pipe-receiving opening;

(b) arranging the lower mounting device and the pipe such that the pipe is anchored to a ground surface in a fixed position and extends upwardly away therefrom through the pipe-receiving opening in the lower mounting device;

(c) with the pipe anchored in the fixed position, sliding the lower mounting device axially along the pipe to select a height along the pipe at which the base is to be positioned to support the hollow post thereon, the height being selected from any of various heights along the pipe relative to the ground surface in order to establish a user-defined height at which the hollow post is to rest on the base;

(d) fastening the lower mounting device directly to the pipe independently of any engagement of the lower mounting device with the ground surface from which the pipe projects to fix the base of the lower mounting device at the user-defined height; and (e) lowering the hollow post over the pipe to the lower mounting device fastened on the pipe until the hollow post is supported on the base of the lower mounting device outward from the pipe.

2. The method according to claim 1 further comprising the step of, prior to step (e), supporting an upper mounting device on the pipe at a position upward therealong from the lower mounting device to subsequently engage the hollow post when lowered over the pipe in step (e).

3. The method according to claim 1 further comprising the step of, after step (d), using the user-defined height of the lower mounting device to determine an elevation at which a second lower mounting device on a second pipe should support a second hollow post.

4. The method according to claim 3 comprising using a straight line to position the second lower mounting device in alignment with the lower mounting device previously installed in step (d).

5. The method according to claim 4 wherein the straight line is provided by a laser level.

6. The method according to claim 4 wherein the straight line is provided by a string.

7. The method according to claim 3 further comprising the step of, prior to step (b), marking positions along the ground surface at which the pipes are to be installed by engaging the lower mounting devices to the ground surface at said positions, wherein step (b) comprises driving the pipe into the ground surface through the pipe receiving opening.

8. The method according to claim 1 further comprising the step of, prior to step (c), digging out earth at a position where the pipe extends upward from the ground surface, wherein step (c) then comprises sliding the lower mounting device along the pipe to position the base below the ground surface.

9. The method according to claim 8 wherein step (d) comprises fastening the lower mounting device to the pipe above the ground surface at a pipe collar extending upward from the base past the ground surface.

10. The method according to claim 1 wherein step (d) comprises engaging the hollow post with one of two post-engaging mechanisms carried on the base, the two post-engaging mechanisms arranged to engage differently sized posts.

11. The method according to claim 10 wherein each post-engaging mechanism comprises at least one protrusion extending upward away from the base for contact with inner surfaces of a respective one of the differently sized posts upon lowering thereof toward the base and the two post-engaging mechanisms comprise inner and outer mechanisms, the inner mechanism being situated between the pipe-receiving opening and the outer mechanism and projecting further upward away from the base than the outer mechanism.

* * * * *